US006267471B1

(12) United States Patent
Ramaswami et al.

(10) Patent No.: US 6,267,471 B1
(45) Date of Patent: Jul. 31, 2001

(54) HIGH-EFFICIENCY POLYCRYSTALLINE SILICON RESISTOR SYSTEM FOR USE IN A THERMAL INKJET PRINTHEAD

(75) Inventors: Ravi Ramaswami, Vancouver, WA (US); Victor Joseph, Fremont; Min Cao, Mountain View, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/427,512

(22) Filed: Oct. 26, 1999

(51) Int. Cl.[7] ..... B41J 2/05
(52) U.S. Cl. ..... 347/63; 347/64
(58) Field of Search ..... 347/63, 64, 62, 347/65, 57, 56, 58, 59

(56) References Cited

U.S. PATENT DOCUMENTS

| | | | | |
|---|---|---|---|---|
| 3,925,106 | | 12/1975 | Ku et al. | 438/383 |
| 4,391,846 | | 7/1983 | Raymond | 438/385 |
| 4,467,519 | | 8/1984 | Glang et al. | 438/330 |
| 4,500,895 | | 2/1985 | Buck et al. | 347/87 |
| 4,513,298 | * | 4/1985 | Scheu | 347/64 |
| 4,532,530 | * | 7/1985 | Hawkins | 347/62 |
| 4,535,343 | | 8/1985 | Wright et al. | 347/64 |
| 4,575,923 | | 3/1986 | Arnold | 29/576 B |
| 4,579,600 | | 4/1986 | Shah et al. | 200/293 |
| 4,719,477 | * | 1/1988 | Hess | 347/59 |
| 4,725,561 | | 2/1988 | Haond et al. | 438/404 |
| 4,771,295 | | 9/1988 | Baker et al. | 347/87 |
| 4,963,189 | | 10/1990 | Hindagolla | 106/31.52 |
| 5,081,473 | | 1/1992 | Hawkins et al. | 347/59 |
| 5,122,812 | | 6/1992 | Hess et al. | 347/59 |
| 5,169,806 | | 12/1992 | Hawkins et al. | 438/21 |
| 5,185,034 | | 2/1993 | Webb et al. | 106/31.43 |
| 5,240,511 | | 8/1993 | Kapoor | 148/33.2 |
| 5,278,584 | | 1/1994 | Keefe et al. | 347/63 |
| 5,742,307 | | 4/1998 | Watrobski et al. | 347/62 |
| 5,975,686 | | 11/1999 | Hauck et al. | 347/85 |

FOREIGN PATENT DOCUMENTS

360120067 * 6/1985 (JP) ..... 347/64

OTHER PUBLICATIONS

Hewlett–Packard Journal, vol. 39, No. 4 (Aug. 1988).

Biegelsen, D.K., et al., "Laser–induced crystallization of silicon islands on amorphous substrates: Multilayer structures", Appl. Phys. Lett., 38(3):150–152, (Feb. 1, 1981).

Colinge, J.P. et al., "Use of selective annealing for growing very large grain silicon on insulator films", Appl. Phys. Lett., 41(4):346–347, (Aug. 15, 1982).

Hawkins, W.G., et al., "Growth of single–crystal silicon islands on bulk fused silica by CO2 laser annealing", Appl. Phys. Lett., 40(4):319–321, (Feb. 15, 1982).

(List continued on next page.)

*Primary Examiner*—John Barlow
*Assistant Examiner*—Juanita Stephens

(57) ABSTRACT

A highly-efficient thermal inkjet printhead. The printhead includes at least one doped polycrystalline silicon resistor which communicates with an external signal source using a unique interconnection system. Specifically, a primary layer of electrically conductive material (optimally a metal silicide) is connected to the resistor. An additional layer of electrically conductive material is attached to and above the primary layer. The additional layer terminates at a position which is spaced outwardly and apart from the resistor to form a gap therebetween. However, the underlying primary layer electrically links the additional layer to the resistor. Alternatively, a dielectric layer is attached to and above the primary layer, with the additional layer being secured to the dielectric layer. At least one electrically conductive contact member is provided within the dielectric layer to link the primary and additional layers. These systems provide improved reliability, greater dimensional simplicity, and optimized electrical/thermal properties.

19 Claims, 8 Drawing Sheets

OTHER PUBLICATIONS

Ku, S.M., "Boron–Implanted Silicon Resistors", Solid State Electronics, 20:803–812 (1977).
Ku, S.M., et al., "Some Annealing Properties of Low–Energy–Antimony—Implanted Silicon Resistors", Solid State Electronics, 22:719–722 (1979).
Kung, K. T–Y., et al., "Seed selection through ion channeling to modify crystallographic orientations of polycrystalline Si films on SiO2: Implant angle dependence", Appl. Phys. Lett., 46(7):683–685, (Apr. 1, 1985).
Kwizera, P., et al., "Solid phase epitaxial recrystallization of thin polysilicon films amorphized by silicon ion implantation", Appl. Phys. Lett., 41(4);379–381, (Aug. 15, 1982).
Lam, H.W., et al., "Characteristics of MOSFETS Fabricated in Laser–Recrystallized Polysilicon Islands with a Retaining Wall Structure on an Insualting Substrate", IEEE Electron Device Letters, vol. EDL–1 No. 10, pp. 206–208, (Oct. 1980).
Song, H.J., et al., "Single–crystal Si island on SiO2 obtained via excimer–laser irradiation of a patterned Si film", Appl. Phys. Lett., 68(22):3165–3167, (May 27, 1996).
Elliott, D. J., *Integrated Circuit Fabrication Technology*, McGraw–Hill Book Company, New York (1982)—(ISBN No. 0–07–019238–3), pp. 1–40, 43–85, 125–143, 165–229, and 245–286.

* cited by examiner

HIGH-EFFICIENCY POLYCRYSTALLINE SILICON RESISTOR SYSTEM FOR USE IN A THERMAL INKJET PRINTHEAD

BACKGROUND OF THE INVENTION

The present invention generally relates to ink delivery systems, and more particularly to a thermal inkjet printhead which is characterized by improved reliability, increased longevity, diminished production costs, cooler printhead operating temperatures, decreased energy consumption, and greater overall printing efficiency. These goals are accomplished through the use of a novel polycrystalline silicon resistor system and interconnect components associated therewith which are located within the printhead as discussed in considerable detail below.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in U.S. Pat. No. 4,500,895 to Buck et al.; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit will be provided at a remote location within the printer, with the ink containment unit being operatively connected to and in fluid communication with the printhead using one or more ink transfer conduits. These particular systems are conventionally known as "off-axis" printing units. Representative, non-limiting off-axis ink delivery systems are discussed in co-owned U.S. patent application Ser. No. 08/869,446 (filed Jun. 5, 1997 and now U.S. Pat. No. 6,158,853) entitled "AN INK CONTAINMENT SYSTEM INCLUDING A PLURAL-WALLED BAG FORMED OF INNER AND OUTER FILM LAYERS" (Olsen et al.) and co-owned U.S. patent application Ser. No. 08/873,612 (filed Jun. 11, 1997 and now U.S. Pat. No. 5,975,686) entitled "REGULATOR FOR A FREE-INK INKJET PEN" (Hauck et al.) which are each incorporated herein by reference. The present invention is applicable to both on-board and off-axis systems (as well as any other types which include at least one ink containment vessel that is either directly or remotely in fluid communication with a printhead containing at least one ink-ejecting resistor therein as will become readily apparent from the discussion provided below.)

Regardless of the particular ink delivery system being employed, an important factor to consider involves the operating efficiency of the printhead with particular reference to the resistor elements that are used to expel ink on-demand during printhead operation. The term "operating efficiency" shall collectively encompass a number of different items including but not limited to internal temperature levels, thermal uniformity, ink delivery speed, expulsion frequency, energy requirements (e.g. current consumption), and the like. Typical and conventional resistor elements used for ink ejection in a thermal inkjet printhead are produced from a number of compositions including but not limited to a mixture of elemental tantalum [Ta] and elemental aluminum [Al] (also known as "TaAl"), as well as other comparable materials including tantalum nitride ("Ta2N"). Polycrystalline silicon may likewise be employed in thermal inkjet printing devices, with the term "polycrystalline silicon" being generally used in a conventional manner to describe a silicon material which basically contains an aggregate of multiple individual crystals. Standard ink delivery resistor systems are discussed in considerable detail in U.S. Pat. No. 4,535,343 to Wright et al. and U.S. Pat. No. 5,122,812 to Hess et al. which are all incorporated herein by reference.

However, the chemical and physical characteristics of the resistor elements and interconnection components associated therewith which are selected for use in a thermal inkjet printhead will directly influence the overall operating efficiency of the printhead. The terms "interconnection components" or "interconnection structures" as employed herein generally involve the conductive traces and related elements which electrically connect the resistors to the printing control circuitry of the system (e.g. on-board or printer-based drive transistors and the like) depending on the type of printing apparatus under consideration. As discussed further below, the claimed invention shall not be restricted to any particular control systems and instead involves a novel arrangement of resistors and interconnection components designed to provide substantially improved operating efficiency.

In any thermal inkjet printing system, it is especially important that the resistor elements (and interconnection components associated therewith) be as energy efficient as possible and capable of operating at low current levels. Resistive compounds having high current requirements are typically characterized by numerous disadvantages including a need for high cost, high-current power supplies in the printer unit under consideration. Likewise, additional losses of electrical efficiency can occur which result from the passage of greater current levels through the electrical interconnect components/structures discussed above that are attached to the resistor(s), with such interconnect structures exhibiting "parasitic resistances". These parasitic resistances cause increased energy losses as greater current levels pass through the above-listed components, with such energy losses being reduced when current levels are diminished. Likewise, high current requirements in the resistor elements and the "parasitic resistances" mentioned above can result in (1) greater overall temperatures within the printhead (with particular reference to the substrate or "die" on which the printhead components are positioned [discussed further below]); and (2) lower printhead reliability/longevity levels.

Another important consideration in the development of an efficient thermal inkjet printhead is the avoidance of a condition conventionally known as "current crowding". This term shall generally be defined to involve a situation where current flow within a conductor or across an interface between two materials becomes highly non-uniform. As a result, current flow occurs within a small area of the conductor causing a very high current density (in amperes per unit area). Accordingly, "current crowding" is caused by a variation in some material property which results in the flow of current preferentially across a small area. For example, consider a situation where electrical current flows along a cylindrically-shaped conductor which will result in the heating of the conductor. If the conductor resistance decreases with increasing temperature, then the outside surface of the conductor will have a higher resistance compared with the center of the structure (because the outside surface can exchange heat more readily with the environment). In this manner, "current crowding" will occur since most of the current will try to flow near the low-resistance center of the structure.

"Current crowding" can reduce the overall reliability in a thermal inkjet resistor system. Depending on the degree to which "current crowding" occurs, a number of different problems can result. Severe current crowding can result in very high local current density and excessive heat generation. If this heat is not effectively removed, the material being heated can melt. "Current crowding" can also lead to problems involving "electromigration". Specifically, in such a situation, "current crowding" causes high current density (but not enough to melt the structure under consideration) which nonetheless results in the physical movement of ions in the structure in the direction of electron flow. This situation can cause the structure of interest to deteriorate and otherwise experience a decrease in functionality. Further information regarding "current crowding" and the novel manner in which the present invention controls/minimizes this problem will be discussed further below in the Detailed Description of Preferred Embodiments section.

Another problem in printhead systems which contain metal structures (e.g. traces) that directly abut the resistor(s) is heat loss. Typically, metals such as aluminum have a very high thermal conductivity. As a result, a portion of the heat generated by the resistor(s) will be lost via heat conduction through abutting metal structures. To compensate for this heat loss, additional energy must be employed in the resistor system, thereby reducing operational efficiency.

Finally, in designing a thermal inkjet printhead, the overall topography (namely, the structural geometry) of the resistor(s) and interconnect structures must be carefully considered. Printhead designs which incorporate a substantial number of non-planar, angular, and/or sloped components in direct proximity with the resistor elements can cause various problems. Specifically, printhead units which employ structures of this nature may be more difficult to effectively cover with the passivation structures and other layers that are normally used to protect the resistor(s) and adjacent components from corrosion. As a result, these protective layers are more prone to various defects including but not limited to cracks, "pinholes", and the like. It is therefore desirable to employ a printhead design which avoids the use of material layers having sloped sidewalls and other geometrical complexities.

In accordance with the information provided above, it is readily apparent that a number of important factors must be considered in the development of a thermal inkjet printhead having a maximum degree of operational efficiency. While prior printhead designs of the type discussed herein have functioned adequately, the foregoing disadvantages leave room for improvement. In this regard, a need remained (prior to development of the present invention) for a resistor system suitable for use in thermal inkjet printing systems of all types which is capable of high efficiency/low current operation that avoids or otherwise minimizes the problems discussed above including "current crowding" and likewise improves overall reliability. The present invention satisfies this need by providing a novel resistor system which represents a substantial improvement over previous designs. The claimed resistor system, its architecture, and the novel interconnect technology associated therewith offer numerous advantages including but not limited to: (1) the effective control/minimization of "current crowding" problems as defined above, with this benefit leading to improved electrical efficiency; (2) reductions in printhead operating temperatures; (3) the general promotion of more favorable temperature conditions within the printhead (which result from reduced current requirements that correspondingly decrease current-based parasitic heat losses from the interconnect structures attached to the resistors); (4) the ability to employ a simplified, substantially planar internal printhead design (with particular reference to the resistor element[s] and associated interconnection hardware) which allows more effective coverage of these components by one or more protective layers; (5) improved overall reliability, stability, and longevity levels in connection with the printhead and resistor elements based on the improvements recited above; (6) the avoidance of heating efficiency problems which can lead to resistor "hot spots", absolute limits on resistance, and the like; (7) the ability to place more resistors within a given printhead in view of the reduced operating temperatures and other factors listed herein which facilitates the reduced-cost production of large-area printheads; and (8) generally superior long-term operating performance. As will become readily apparent from the discussion provided below, the novel structures, component arrangements, and fabrication techniques associated with the invention offer these and other important advantages over prior systems.

In accordance with the detailed information provided below, the present invention involves a thermal inkjet printhead having a novel resistor system which is unique in structure, arrangement, and functional capability. Also encompassed within the invention is an ink delivery system using the claimed printhead and manufacturing methods for producing the printhead with particular reference to the heating resistors and interconnection hardware. Each of these developments will be outlined in considerable detail herein. Accordingly, the present invention represents a significant advance in thermal inkjet technology which ensures high levels of operating efficiency, excellent image quality, rapid throughput, and increased longevity/reliability which are important goals in any printing system.

SUMMARY OF THE INVENTION

It is an object of the present invention to provide a highly efficient thermal inkjet printhead which is characterized by improved operating efficiency.

It is another object of the invention to provide a highly efficient thermal inkjet printhead which employs an internal resistor system of novel design that offers superior thermal stability and reduced operating temperatures.

It is another object of the invention to provide a highly efficient thermal inkjet printhead which employs a novel resistor system that is characterized by improved electrical efficiency resulting from reduced current requirements.

It is another object of the invention to provide a highly efficient thermal inkjet printhead which employs a novel resistor system that effectively controls/minimizes "current crowding", electromigration, and the like.

It is another object of the invention to provide a highly efficient thermal inkjet printhead which employs a novel resistor system that effectively controls/minimizes "current crowding" problems by using a component arrangement in which each metallic interconnection trace terminates within the printhead at a location that is remotely spaced from its respective resistor. Connection of the resistor to the metallic trace is achieved using an intermediate layer of special material between the trace and resistor which forms a conductive bridge. In this manner, a direct connection between the metallic trace and resistor is avoided which minimizes undesired heat loss, "current crowding", and the like.

It is another object of the invention to provide a highly efficient thermal inkjet printhead which employs a novel resistor system that promotes favorable temperature conditions within the printhead. These conditions provide higher-speed printing, better image quality, and the avoidance of "hot spots" which often occur in traditional printheads at the junction between each resistor and its respective metallic interconnection trace.

It is another object of the invention to provide a highly efficient thermal inkjet printhead which, in accordance with the benefits listed above, is able to employ increased numbers of heating resistors per unit area compared with standard systems.

It is a further object of the invention to provide a highly efficient thermal inkjet printhead which is characterized by substantially improved reliability levels.

It is a further object of the invention to provide a highly efficient thermal inkjet printhead in which the improved reliability levels listed above are achieved by using a simplified, substantially-planar topography relative to the resistors and the interconnection structures associated therewith. This design is distinguishable from prior systems which typically employ at least one sloped or angled interconnection member. The avoidance of geometrically-complex structures in the printhead enables passivation layers and other comparable components to be applied in a more effective manner which minimizes defect formation.

It is a further object of the invention to provide a highly efficient thermal inkjet printhead which employs a novel resistor system is able to offer all of the foregoing benefits using resistor structures that are configured in a number of different shapes, sizes, and orientations without limitation.

It is a further object of the invention to provide a highly efficient thermal inkjet printhead in which the beneficial features thereof yield a printing system that is characterized by rapid operation and the generation of stable printed images.

It is a further object of the invention to provide a highly efficient thermal inkjet printhead in which the claimed structures are readily manufactured in an economical fashion on a mass-production scale.

It is a further object of the invention to provide a rapid and effective method for manufacturing a thermal inkjet printhead having the beneficial characteristics, features, and advantages outlined herein.

It is a further object of the invention to provide a rapid and effective method for manufacturing a thermal inkjet printhead having the beneficial characteristics, features, and advantages outlined herein which uses a minimal number of process steps and is effectively implemented using mass production fabrication techniques.

It is an even further object of the invention to provide a specialized printhead of the type described above which is readily applicable to a wide variety of different ink delivery systems including (1) on-board cartridge-type units having a self-contained supply of ink associated therewith; and (2) off-axis systems as previously discussed in which the claimed printhead is operatively connected to a remotely-positioned ink containment vessel using one or more tubular conduits.

A novel and highly efficient thermal inkjet printhead is described below which provides numerous advantages over prior systems. As previously stated, the claimed printhead employs at least one resistor element (or, more simply, a "resistor") and a novel interconnection system associated therewith which are collectively characterized by multiple benefits compared with conventional devices. These benefits again include increased electrical efficiency resulting from the control/minimization of "current crowding", the avoidance of complex (e.g. sloped) architectural features in connection with the resistor and interconnection structures (which facilitates the more effective placement of protective passivation layers thereover), the promotion of more favorable temperature conditions within the printhead including reduced substrate or "die" temperatures, and greater overall levels of reliability, longevity, economy, and stability. These and other benefits will become readily apparent from the discussion provided below in the Detailed Description of Preferred Embodiments section.

As a preliminary point of information, the present invention shall not be restricted to any particular types, sizes, or arrangements of internal printhead components unless otherwise stated herein. Likewise, the numerical parameters listed in this section and the other sections below constitute preferred embodiments designed to provide optimum results and shall not limit the invention in any respect. All recitations of chemical formulae and structures set forth herein are designed to generally indicate the types of materials which may be used in the invention. The listing of specific chemical compositions which fall within the general formulae presented below are recited for example purposes only and shall be considered non-limiting.

The claimed invention and its novel developments are applicable to all types of thermal inkjet printing systems which include (1) at least one support structure as discussed in the Detailed Description of Preferred Embodiments section; and (2) at least one ink-ejecting resistor element located inside the printhead which, when energized, will provide sufficient heat to cause ink materials in proximity therewith to be thermally expelled from the printhead. The claimed invention shall therefore not be considered printhead or support structure-specific and is not limited to any particular applications, uses, and ink compositions. Likewise, the terms "resistor element" and/or "resistor" shall be construed to cover one resistor or groups of multiple resistors regardless of shape, material-content, or dimensional characteristics.

It is a primary goal to provide improved stability, economy, reliability, and longevity in the printhead structures of this invention. For the sake of clarity and in order to adequately explain the invention, specific materials and processes will again be recited in the Detailed Description of Preferred Embodiments section with the understanding that these items are being described for example purposes only in a non-limiting fashion.

It should also be understood that the claimed invention shall not be restricted to any particular construction techniques (including any given material deposition procedures) unless otherwise stated below. For example, the terms "forming", "applying", "delivering", "placing", "operatively attaching", "operatively connecting", "converting", "providing", and the like as used throughout this discussion shall broadly encompass any appropriate manufacturing procedures. These processes range from thin-film fabrication techniques and sputter deposition methods to pre-manufacturing the components in question (including the resistor elements and interconnection components) and then adhering such items to the designated support structures using one or more adhesive compounds which are known in the art for this purpose. Also encompassed with the terms listed above are processes which selectively manipulate and otherwise alter the chemical structure of a single material layer in order to produce one or more discrete components therefrom. For example, as outlined in the Detailed Description of Preferred Embodiments section, it is possible to form the resistor elements and one or more conductive structures from a single material layer by selectively treating various portions of the layer to achieve this goal. In this regard, the invention shall not be considered "production method specific" unless otherwise stated herein, with the recitation of any particular fabrication techniques being provided for example purposes only.

Likewise, it shall be understood that the terms "operative connection", "operative attachment", "in operative connection", "in operative attachment", and the like as used and claimed herein shall be broadly construed to encompass a variety of divergent attachment/connection arrangements including but not limited to (1) the direct attachment of one component to another component with no intervening materials therebetween; and (2) the attachment of one component to another component with one or more material layers therebetween provided that the one component being "attached" or "connected" to the other component is somehow "supported" or generally in electrical communication with the other component (notwithstanding the presence of one or more additional material layers therebetween). Likewise, any statement which indicates that one layer of material is "above" another layer shall involve a conventional situation wherein the one particular layer that is "above" the other layer in question shall be the outermost of the two layers relative to the interior of the printhead, with the other layer being innermost. The opposite situation will be applicable regarding use of the term "below". The characterizations listed above shall be effective regardless of the orientation of the printhead.

As previously noted, a highly effective and durable printhead containing at least one resistor is provided for use in an ink delivery system. The term "ink delivery system" shall, without limitation, involve a wide variety of different devices including cartridge units of the "self-contained" type having a supply of ink stored therein. Also encompassed within this term are printing units of the "off-axis" variety which employ a printhead connected by one or more conduit members to a remotely-positioned ink containment unit in the form of a tank, vessel, housing, or other equivalent structure. Regardless of which ink delivery system is employed in connection with the claimed printhead, the present invention is capable of providing the benefits listed above which include more efficient, rapid, and reliable operation.

The following discussion shall constitute a brief and general overview of the invention. More specific details concerning particular embodiments, best modes, and other important features of the invention will again be recited in the Detailed Description of Preferred Embodiments section set forth below. All scientific terms used throughout this discussion shall be construed in accordance with the traditional meanings attributed thereto by individuals skilled in the art to which this invention pertains unless a special definition is provided herein.

The claimed invention involves a novel resistor-containing inkjet printhead which is characterized by improved functional characteristics, namely, more efficient operation with improved reliability, the promotion of favorable temperature conditions within the printhead, the ability to generate clear and defined printed images in a rapid manner with greater overall longevity, reduced peak operating temperatures as noted above, decreased energy requirements, the ability to use greater numbers of resistors per unit area, and the like. The components and novel features of this system will now be discussed. In order to produce the claimed printhead, a support structure is initially provided on which the resistor elements and novel interconnect components of the invention reside. The terms "interconnect components" and "interconnect structures" shall be deemed equivalent and are defined above. The support structure typically comprises a substrate which is optimally manufactured from elemental silicon [Si], although the present invention shall not be exclusively restricted to this material with a number of other alternatives being outlined below. The support structure may have at least one or more layers of material thereon including but not limited to an electrically-insulating base layer produced from, for example, silicon dioxide [$SiO_2$]. The term "support structure" as used herein shall therefore encompass (1) the substrate by itself if no other material layers are positioned thereon; and (2) the substrate and any other material layers positioned on the substrate which form a composite structure on which the resistors reside or are otherwise positioned. In this regard, the phrase "support structure" shall generally involve the layer or layers of material (whatever they may be) on which the resistor elements and interconnection components are placed/formed.

Also provided as part of the printhead in a preferred and non-limiting embodiment is at least one layer of material which specifically comprises at least one opening or "orifice" therethrough. This orifice-containing layer of material may be characterized as an "orifice plate", "orifice structure", "top layer", and the like. Furthermore, single or multiple layers of materials may be employed for this purpose without restriction, with the terms "orifice plate", "orifice structure", etc. being defined to encompass both single and multiple layer embodiments. The resistor element (s) of the present invention are positioned between the orifice-containing layer of material and the support structure as discussed below and shown in the accompanying drawing figures. Again, additional detailed information regarding these components, what they are made from, how they are arranged, and the manner in which they are assembled/fabricated will be outlined below in the Detailed Description of Preferred Embodiments section.

With continued reference to the printhead components mentioned above, at least one resistor element is positioned within the printhead (optimally between the support structure and the orifice-containing layer) for expelling ink on-demand from the printhead. The resistor is in fluid communication with a supply of ink as shown in the accompanying drawing figures so that effective printing can occur. Likewise, the resistor is specifically placed on the support structure in a preferred embodiment, with the terms "placed", "positioned", "located", "oriented", "operatively attached", "operatively connected", "formed", and the like relative to placement of the resistor on the support structure encompassing a situation in which (1) the resistor is secured directly on and to the upper surface of the substrate under consideration without any intervening material layers therebetween; or (2) the resistor is "supported" by the substrate in which one or more intermediate material layers (including any insulating base layer[s]) are nonetheless located between the substrate and resistor. Both of these alternatives shall be considered equivalent and encompassed within the present claims.

In accordance with a preferred embodiment of present invention, the resistor element (also characterized in this discussion as simply a "resistor") is produced from at least one composition which shall be designated herein as a "doped polycrystalline silicon" compound. The term "polycrystalline silicon" is defined above and shall be construed in accordance with the conventional definition thereof. Doping of the polycrystalline silicon is likewise undertaken in a standard manner as discussed below, with the term "doping" involving a situation in which selected "impurities" are added to a material in order to alter its chemical, physical, and/or electrical characteristics. The use of a doped polycrystalline silicon material in the present invention will be reviewed extensively in the Detailed Description of Preferred Embodiments section with the further understanding that this material (in a general sense) is known in the semiconductor art. However, in a preferred embodiment designed to provide optimum results, representative and non-limiting doped polycrystalline silicon compositions which are suitable for use herein include but are not limited to phosphorous-doped polycrystalline silicon, boron-doped polycrystalline silicon, arsenic-doped polycrystalline silicon, antimony-doped polycrystalline silicon, and mixtures thereof.

At this point, the novel interconnection system of the present invention will be generally summarized with the understanding that the following description is only a brief overview, with more detailed data being provided below. The claimed interconnection system is designed to provide numerous important benefits including the control/minimization of "current crowding" and electromigration (both defined above), with these benefits being achieved by isolating and separating the resistor in question from the main metallic circuit trace system which is normally used to connect the resistor to a selected drive transistor or other control device. In accordance with the present invention, the isolation of these components from each other is achieved by employing a specialized conductive "bridge" structure therebetween. This structure allows the resistor element and metallic circuit trace under consideration to electrically communicate while avoiding direct contact between such components. To accomplish this goal, a primary layer of electrically conductive material is provided which is operatively connected to the resistor element. In order to achieve optimum results, the primary layer of electrically conductive material is comprised of a selected metal silicide compound, with the following non-limiting representative examples being applicable: titanium silicide ($TiS_2$), cobalt silicide ($CoSi_2$), tungsten silicide ($WSi_2$), platinum silicide (PtSi), palladium silicide ($Pd_2Si$), molybdenum silicide ($MoSi_2$), tantalum silicide ($TaSi_2$), and mixtures thereof.

As further described below, many different methods may be employed to fabricate the resistor and primary layer of electrically conductive material without limitation. These methods include pre-fabrication of the foregoing and other elements in the printhead followed by attachment to each other during the assembly process. Also, conventional layering and material deposition techniques can be used in order to fabricate the various components of the printhead. However, in a preferred embodiment as outlined in considerable detail below, the resistor and primary layer are both optimally produced from a single layer of doped polycrystalline silicon in which various regions or portions of the polycrystalline silicon are treated in different ways to create the desired components therefrom on an in situ basis. In accordance with specific data provided in the Detailed Description of Preferred Embodiments section, a selected resistor is produced from the polycrystalline silicon by doping the same in a conventional manner. One or more other regions or portions associated with the doped polycrystalline silicon (preferably adjacent to the resistor and in operative connection thereto) are then treated by the application of a selected metal to the upper face of such regions which results in the in situ formation of a metal silicide layer on and within the upper face. This layer constitutes the primary layer of electrically conductive material mentioned above (which is operatively connected to the resistor). As previously noted, however, the claimed invention shall not be restricted to any particular formation methods in connection with the primary layer, with the example offered above involving a preferred embodiment. Other techniques can be employed for this purpose including but not limited to the deposition of a metal silicide layer using, for example, sputtering or other standard methods as discussed further below.

It should likewise be noted that the resistor element has a substantially planar top surface, with the primary layer of electrically conductive material likewise comprising a substantially planar upper face (discussed in detail below and illustrated in the accompanying drawing figures). In an exemplary, non-limiting, and preferred embodiment which represents a substantial departure from prior systems, the upper face of the primary layer and the top surface of the resistor are substantially coplanar with each other (and vice versa). The term "coplanar" as employed herein shall involve a relationship in which the upper face of the primary layer and the top surface of the resistor element are both in the same plane and predominantly level with each other. The word "substantially" as used in connection with "coplanar" is employed herein to account for slight allowable deviations from exact coplanarity which are always possible in view of permitted production tolerances and other related factors. Further information regarding this aspect of the claimed invention will be presented below in the Detailed Description of Preferred Embodiments section.

In accordance with a preferred form of the invention designed to provide optimum results, the resistor/primary layer combination discussed above is substantially devoid of sharp edges, angles, slopes and the like in order to create a flat/planar configuration (in direct contrast to the "sloped" topography associated with prior systems.) This design is especially well-suited to the placement of one or more protective passivation layers thereon which not subject to defect formation in the same manner associated with conventional systems which employ "sloped" structures. Specifically, the placement of protective passivation layers on printhead structures with sharp angles, slopes, and the like creates a situation in which the layers that cover these topographical features are subject to various defects including cracks, pinholes, and the like. As a result, ineffective coverage and protection of the underlying structures (including the resistor[s]) occurs. These problems are substantially avoided in the present invention which is again characterized by a flat, non-sloped topography in the various regions of the printhead surrounding the resistor element(s), with this topography being ideally suited to passivation layer formation.

Next, at least one additional layer of electrically conductive material is provided which is positioned above the primary layer of electrically conductive material and operatively attached thereto. In a preferred and non-limiting embodiment, the additional layer of electrically conductive material is optimally produced from at least one elemental metal or multiple elemental metals in combination which form a metallic mixture, alloy, and/or amalgam. For example, the following exemplary compositions can be used to form the additional layer of electrically conductive material: an alloy of copper (Cu) and aluminum (Al), gold (Au), titanium (Ti), tungsten [W], cobalt [Co], molybdenum [Mo], tantalum [Ta], platinum [Pt], and combinations thereof. As previously noted, the term "operatively attached" (as well as the other comparable statements provided above including "operatively connected") shall be broadly construed to encompass situations involving (1) the direct attachment of one component to another component with no intervening material layers therebetween; and (2) the attachment of one component to another component with one or more material layers therebetween. Likewise, the term "at least one" as used in the present discussion shall encompass one or more of the elements in question.

In accordance with the accompanying drawing figures, the additional layer of electrically conductive material includes an inner end which terminates at a position within the printhead that is spaced outwardly and apart from the resistor element in order to form a gap therebetween. The existence of this gap is of technical importance in this case since it prevents direct contact between the metal-containing additional layer of electrically conductive material and the resistor element, with such direct contact causing a number of problems in conventional thermal inkjet printheads. These difficulties are discussed above and include but are not limited to "current crowding" as previously defined (along with accompanying electromigration problems) and "hot spots" which would normally occur at the junction between the resistor and the metallic trace being employed. These problems are again avoided in the present invention by the configuration discussed above which uses a "bridge" structure that is made from a compound (at least one metal silicide) that substantially minimizes "current crowding" and the like. The primary layer of electrically conductive material made from a selected metal silicide composition as previously described functions as the "bridge" structure in this case. While the claimed invention shall not be restricted to any particular sizes, dimensions, and the like, optimum results are achieved if the gap (e.g. "zone of separation") between the resistor and the additional layer of electrically conductive material has a preferred and non-limiting length of about 5–100 $\mu$m. This length shall likewise be construed to involve the distance between the inner end of each additional layer of electrically conductive material and its respective resistor. However, the ultimate size of the gap between these components may be varied as needed in accordance with routine preliminary pilot testing involving the particular printhead under consideration.

Each additional layer of electrically conductive material is operatively connected at its outer end to one or more drive transistors or other appropriate control circuits which are used to deliver electrical firing impulses to the resistor in question. However, to create an electrically conductive pathway between the additional layer and the resistor (which is required in order to ensure proper impulse delivery), the primary layer discussed above is again used to form an electrically conductive "bridge" within the gap between the additional layer and the resistor. In this manner, electrical communication between the additional layer (which is optimally made from one or more metals in combination) and the resistor is established without requiring "direct" engagement between these components. Instead, such communication is established using the primary layer of electrically conductive material which is specifically produced from a selected metal silicide. When placed in direct contact/physical engagement with the resistor element, the metal silicide-containing primary conductive layer minimizes the "current crowding", electromigration, and other problems recited above. These benefits are achieved in accordance with the unique chemical character of metal silicide compounds (which, while not completely understood, function differently from elemental metals and combinations thereof in the current invention). Again, further explanatory information regarding this important feature of the claimed invention will be discussed in greater detail below.

In addition to the basic system discussed herein which is novel, unique, and functionally beneficial, a number of alternative embodiments exist which will now be summarized. For example, a first alternative system is provided which is substantially identical to the basic apparatus discussed above (the "main embodiment") with two primary exceptions. Aside from these exceptions, all of the information presented above concerning the main embodiment is fully applicable to the present alternative embodiment, with such information being incorporated in this section by reference.

To manufacture the alternative printhead, all of the steps used in the main embodiment to produce the resistor and the primary layer of electrically conductive material are employed (using the same construction materials and other operational parameters). However, after the primary layer of electrically conductive material has been fabricated as previously stated, a protective layer of dielectric material is positioned above and operatively attached to the primary layer and resistor in order to cover both components. The term "dielectric" as used herein shall involve the conventional definition thereof, namely, a material that is an electrical insulator or in which an electric field can be sustained with minimum power dissipation. While the claimed invention shall not be limited to any particular dielectric materials in connection with the protective layer, exemplary and preferred compositions which are suitable for this purpose include but are not limited to silicon carbide [SiC], silicon nitride [$Si_3N_4$], and mixtures thereof.

The metal-containing additional layer of electrically conductive material as previously discussed is then positioned above and operatively attached to the protective layer of dielectric material. All of the characteristics of the additional layer in this embodiment are the same as those which were previously described in connection with the main embodiment. For example, the additional layer of electrically conductive material in this embodiment likewise includes an inner end which terminates at a position within the printhead that is spaced outwardly and apart from the resistor element in order to form a gap therebetween.

However, to ensure that proper electrical communication occurs between the additional layer and the primary layer (which are separated by the protective layer of dielectric material), the present alternative embodiment provides at least one electrically conductive contact member positioned/embedded within the protective layer. The contact member (as illustrated in the accompanying drawing figures and described in the Detailed Description of Preferred Embodiments) is operatively connected to and positioned between (1) the additional layer of electrically conductive material which is located above the protective layer; and (2) the primary layer of electrically conductive material which is located below the protective layer. In this manner, the contact member forms an electrically conductive "link" between the additional and primary layers notwithstanding the protective layer of dielectric material located between these structures.

To achieve optimum results, representative, preferred, and non-limiting compositions which may be used to produce the contact member(s) include the same materials recited above in connection with the additional layer of electrically conductive material. In particular, it is preferred (but not required) that both the additional layer and the contact member be manufactured from the same compositions. In a representative and non-limiting embodiment, the contact member(s) are optimally produced from at least one elemental metal or multiple elemental metals in combination which form a metallic mixture, alloy, and/or amalgam. For example the following exemplary metallic compositions can be used to produce the contact member(s): an alloy of copper (Cu) and aluminum (Al), gold (Au), titanium (Ti), tungsten [W], cobalt [Co], molybdenum [Mo], tantalum [Ta], platinum [Pt], and combinations thereof.

All of the other parameters associated with the current alternative embodiment are again substantially the same as those associated with the main embodiment including but not limited to the construction materials that are employed in connection with the resistor element, the primary layer of electrically conductive material, and the additional layer of electrically conductive material. Likewise, the size of the gap between the additional layer and the resistor element, as well as the preferred coplanar relationship between the upper face of the primary layer and the top surface of the resistor element are common to both embodiments. However, the current alternative embodiment is designed to provide a number of supplemental benefits in addition to those recited herein which will be reviewed extensively in the Detailed Description of Preferred Embodiments section. A decision to employ the alternative embodiment described above shall be undertaken in accordance with routine preliminary pilot testing taking into account the particular inkjet printing system being employed and its desired characteristics.

Finally, a further alternative embodiment may likewise be produced in accordance with the invention which employs all of the characteristics, features, and components of the main embodiment listed above, with the description of such items again being incorporated in this section by reference. This additional embodiment employs an intermediate portion of electrically conductive material which is positioned between (1) the primary layer of electrically conductive material; and (2) the resistor element in order to form an electrically conductive pathway therebetween. While the currently-described alternative embodiment shall not be restricted to any particular compositions for producing the intermediate portion of electrically conductive material, doped polycrystalline silicon is preferably employed for this purpose. However, to achieve the desired benefits of this embodiment (discussed below), it is preferred that the doping level of the intermediate portion be greater than the doping level associated with the polycrystalline silicon which is used to form the resistor element. The term "doping level" as employed herein shall be defined to encompass the number of dopant atoms which are present in the layer of material under consideration per $cm^3$ thereof. To achieve optimum results, the resistor element and the intermediate portion of electrically conductive material will be produced from the same type of polycrystalline silicon including but not limited to phosphorous-doped polycrystalline silicon, boron-doped polycrystalline silicon, arsenic-doped polycrystalline silicon, antimony-doped polycrystalline silicon, and mixtures thereof. The use of common (e.g. the same) materials in connection with the resistor element and the intermediate portion of electrically conductive material is desirable since an effective production method (discussed below) will involve fabrication of the resistor element and the intermediate portion from the same layer of polycrystalline silicon, with the selective treatment of various layer portions or sections generating both structures. Further information regarding numerical doping levels, representative doping processes, and other factors associated with the use of doped polycrystalline silicon will be provided in the Detailed Description of Preferred Embodiments section below.

All of the other parameters associated with this particular alternative embodiment are substantially the same as those employed in the main embodiment including but not limited to the construction materials that are used in connection with (1) the resistor element; (2) the primary layer of electrically conductive material; and (3) the additional layer of electrically conductive material. Likewise, the size of the gap between the additional layer and the resistor element, as well as the preferred coplanar relationship between the upper face of the primary layer and the top surface of the resistor element are also common to all embodiments. A decision to employ the alternative embodiment described in this section shall be undertaken in accordance with routine preliminary pilot testing taking into account the particular inkjet printing system being employed and its desired characteristics. In addition, the use of an intermediate portion of electrically conductive material as outlined above (if desired) is applicable to all of the other embodiments described herein without restriction.

In accordance with the present invention, an "ink delivery system" is likewise provided in which an ink containment vessel is operatively connected to and in fluid communication with the printheads described herein, with all of the information provided above regarding the claimed printhead designs being incorporated by reference in this section. As further discussed below, the term "operatively connected" relative to a given printhead and ink containment vessel shall involve a number of different situations including but not limited to (1) cartridge units of the "self-contained" type in which the ink containment vessel is directly attached to the printhead to produce a system having an "on-board" ink supply; and (2) printing units of the "off-axis" variety which employ a printhead connected by one or more conduit members (or similar structures) to a remotely-positioned ink containment unit in the form of a tank, vessel, housing, or other equivalent structure. The novel printhead structures of the present invention shall not be limited to use with any particular ink containment vessels, the proximity of these vessels to the printheads, and the means by which the vessels and printheads are attached to each other.

Finally, the present invention shall also encompass one or more methods for producing the novel printhead structures described above. It shall be understood that the invention is not limited to any particular printhead fabrication techniques, with a number of different methods being applicable. The manufacturing steps which are generally used for this purpose involve the materials and components recited above, with the previously-described summary of these items being incorporated by reference in this discussion. The basic production steps which are used to fabricate the printhead associated with the main embodiment are as follows: (1) providing at least one resistor element of the type discussed above for expelling ink on-demand from the printhead, with the resistor element being comprised of a doped polycrystalline silicon composition; (2) forming a primary layer of electrically conductive material produced from a metal silicide compound which is operatively connected to the resistor element; and (3) operatively attaching an additional layer of electrically conductive material in position within the printhead above the primary layer of electrically conductive material, with the additional layer terminating at a position inside the printhead which is spaced outwardly and apart from the resistor element in order to form a gap therebetween. As previously stated, the primary layer of electrically conductive material is used to create a conductive "bridge" within the gap between the additional layer and the resistor element. In this manner, electrical communication is established between the resistor element and the additional layer without direct contact therebetween so that "current crowding" and other adverse effects can be minimized.

The terms "forming", "fabricating", "producing", "operatively attaching", "operatively connecting", "converting", and the like regarding the techniques which are used to assemble the claimed components in all of the embodiments of this invention shall be defined to include: (A) creating the layer or component in question directly from materials which are present or otherwise reside in the printhead on an in situ basis; (B) fabricating the layer or component under consideration using one or more material deposition processes (e.g. sputtering, plasma-enhanced chemical vapor deposition [PECVD], and the like) which are known in the art and discussed in considerable detail below; and (C) pre-manufacturing the layer or component in question and thereafter securing it in position within the printhead using chemical or physical attachment means (soldering, adhesive affixation, and the like).

In a preferred embodiment as noted above, both the resistor and the primary layer of electrically conductive material shall be made from the same composition, namely, the initial layer of doped polycrystalline silicon material. This process involves the following steps: (1) providing a layer comprised of doped polycrystalline silicon; (2) forming at least one resistor element from at least one portion of the doped polycrystalline silicon layer; (3) converting at least one additional portion of the doped polycrystalline silicon layer into a metal silicide compound in order to generate a primary layer of electrically conductive material made from the metal silicide compound (with the conversion process being specifically outlined below); and (4) operatively attaching at least one additional layer of electrically conductive material in position within the printhead above the primary layer of electrically conductive material, with the additional layer terminating at a position inside the printhead which is spaced outwardly and apart from the resistor element in order to form a gap therebetween. As previously stated, the primary layer of electrically conductive material is used to generate a conductive "bridge" within the gap between the additional layer and the resistor element. Incidentally, the process discussed above may be modified to further dope the additional portion of polycrystalline silicon prior to conversion into the metal silicide composition. As a result, the additional portion has a doping level which is greater than that of the initial portion of doped polycrystalline silicon which was used to produce the resistor. The benefits associated with this process will likewise be outlined below.

The basic procedures summarized above may also be modified in order to fabricate various printhead structures associated with one or more of the alternative embodiments mentioned earlier in this section. Regarding the alternative embodiment which employs a protective layer of dielectric material having at least one electrically conductive contact member therein, a preferred production process is as follows: (1) providing at least one resistor element for expelling ink on-demand from the printhead, with the resistor element being comprised of a doped polycrystalline silicon composition; (2) forming a primary layer of electrically conductive material produced from a metal silicide compound which is operatively connected to the resistor element; (3) operatively attaching a protective layer of dielectric material in position within the printhead above the primary layer of electrically conductive material and the resistor element so that both of these items are effectively covered by the protective layer; (4) forming at least one electrically conductive contact member within the protective layer of dielectric material; and (5) operatively attaching at least one additional layer of electrically conductive material in position within the printhead above the protective layer of dielectric material. The additional layer terminates at a position within the printhead which is spaced outwardly and apart from the resistor element in order to form a gap therebetween. Likewise, the contact member is operatively connected to both the additional layer of electrically conductive material which is located above the protective layer and the primary layer of electrically conductive material which is located below the protective layer. In this manner, the contact member forms an electrically conductive link between both layers.

The completed printheads described herein are designed to generate a printed image from an ink supply in response to a plurality of successive electrical impulses delivered to the resistors. The novel features discussed above individually and collectively constitute a significant advance in the art of thermal inkjet technology and the generation of high-quality images with improved reliability, speed, longevity, stability, and electrical/thermal efficiency. In particular, the unique structures, components, and methods summarized above offer many important benefits compared with prior systems including but not limited to: (1) the effective control/minimization of "current crowding" problems as previously defined, with this benefit leading to improved electrical efficiency; (2) reductions in printhead operating temperatures; (3) the general promotion of more favorable temperature conditions within the printhead (which result from reduced current requirements that correspondingly decrease current-based parasitic heat losses from the interconnect structures attached to the resistors); (4) the ability to employ a simplified, substantially planar internal printhead design (with particular reference to the resistor element[s] and associated interconnection hardware) which allows more effective coverage of these components with one or more protective layers; (5) improved overall reliability, stability, and longevity levels in connection with the printhead and resistor elements based on the improvements recited above; (6) the avoidance of heating efficiency problems which can lead to resistor "hot spots" , absolute limits on resistance, and the like; (7) the ability to place more resistors within a given printhead in view of the reduced operating temperatures and other factors listed above which facilitates the reduced-cost production of large-area printheads; and (8) generally superior long-term operating performance. These and other benefits, objects, features, and advantages of the invention will become readily apparent from the following Brief Description of the Drawings and Detailed Description of Preferred Embodiments.

BRIEF DESCRIPTION OF THE DRAWINGS

The drawing figures provided below are schematic, representative only, and not necessarily drawn to scale. They shall not limit the scope of the invention in any respect. Reference numbers which are carried over from one figure to another shall constitute common subject matter in the figures under consideration. Likewise, the cross-hatching shown in the drawing figures is provided for example purposes only and shall not restrict the invention to any particular construction materials.

DETAILED DESCRIPTION OF PREFERRED EMBODIMENTS

Figure 1:
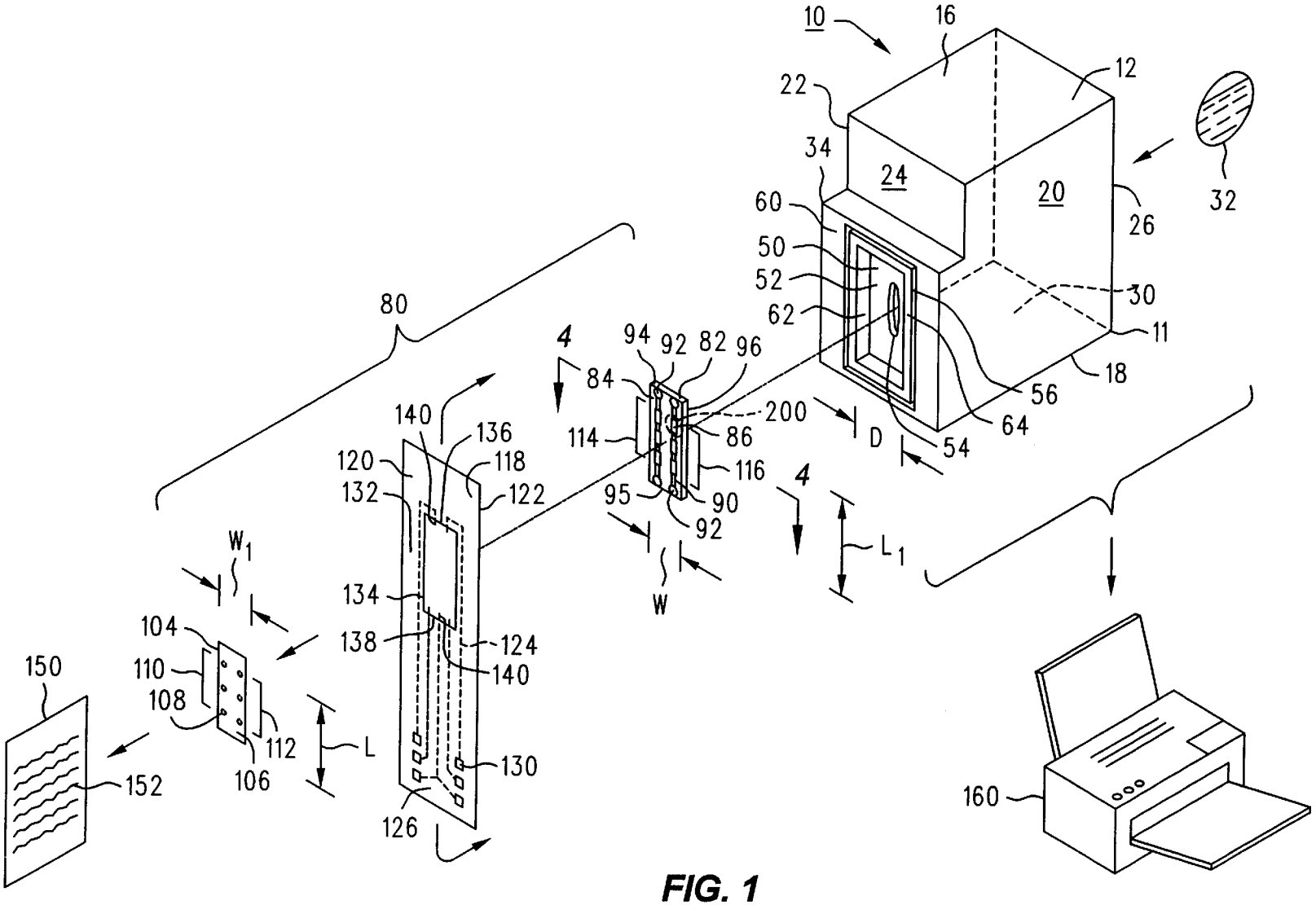
FIG. 1 is a schematically-illustrated, exploded perspective view of a representative ink delivery system in the form of an ink cartridge which is suitable for use with the components and methods of the present invention. The ink cartridge of FIG. 1 has an ink containment vessel directly attached to the printheads of the claimed invention so that an "on-board" ink supply is provided.

In accordance with the present invention, a high-efficiency thermal inkjet printhead for an ink delivery system is disclosed having improved energy efficiency, optimized thermal qualities, and substantially increased reliability. The novel printhead is characterized by many important features including reduced internal temperatures, minimized current requirements which enable lower-cost power supplies to be employed, decreased energy losses in the system, a high degree of versatility, the control/minimization of numerous problems including "current crowding", electromigration, and the like, increased resistance to the corrosive effects of ink compositions, and improved reliability over prolonged time periods. All of these benefits are directly attributable to the specialized arrangement of components in the claimed printhead structure with particular reference to the distinctive manner in which the interconnect structures (namely, the circuit traces and related elements) are placed in electrical communication/connection with the resistors. Specifically, direct contact between the polycrystalline silicon resistors in the system and the metallic circuit elements which are used to transfer impulses thereto is avoided, thereby preventing the problems listed above which typically occur when such materials are directly joined. Instead, as discussed in considerable detail below, the foregoing components are effectively "bridged" using a metal silicide layer which not only provides the advantages discussed herein, but facilitates the production of a more even and planar internal topography in the vicinity of the resistors. As a result, subsequently-applied passivation layers are less subject to defect formation compared with previous systems which employ a variety of components having sharp angles, slopes, and the like that are more difficult to cover in an effective manner. Accordingly, the resistor system described herein (with the term "resistor system" involving the selected resistor[s] and associated interconnection structure[s]) offers numerous advantages over conventional designs. The term "thermal inkjet printhead" as used in this discussion shall be broadly construed to encompass, without restriction, any type of printhead having at least one heating resistor therein which is designed to thermally excite ink materials for delivery to a print media material (paper, metal, plastic, and the like). In this regard, the invention shall not be limited to any particular thermal inkjet printhead designs and resistor shapes/configurations with many different structures and internal component arrangements being possible provided that they include the resistor structures mentioned above which expel ink on-demand using thermal processes.

Likewise, as previously noted, the claimed printhead is prospectively applicable to many different ink delivery systems including (1) on-board cartridge-type units having a self-contained supply of ink therein which is operatively connected to and in fluid communication with the printhead; and (2) "off-axis" units which employ a remotely-positioned ink containment vessel that is operatively connected to and in fluid communication with the printhead using one or more fluid transfer conduits. The printhead of the present invention shall therefore not be considered "system specific" relative to the ink storage devices associated therewith. To provide a clear and complete understanding of the invention, the following detailed description will be divided into four sections, namely, (1) "A. A General Overview of Thermal Inkjet Technology"; (2) "B. A General Review of the Resistor Elements and Associated Structures within a Conventional Printhead"; (3) "C. The Novel Resistor Systems of the Present Invention and Representative Fabrication Methods Associated Therewith"; and (4) "D. Ink Delivery Systems using the Printheads of the Present Invention".

A. A General Overview of Thermal Inkjet Technology

The present invention is again applicable to a wide variety of ink delivery systems which include (1) a printhead; (2) at least one heating resistor associated with the printhead; and (3) an ink containment vessel having a supply of ink therein that is operatively connected to and in fluid communication with the printhead. The ink containment vessel may be directly attached to the printhead or remotely connected thereto in an "off-axis" system as previously discussed using one or more ink transfer conduits. The phrase "operatively connected" as it applies to the printhead and ink containment vessel shall encompass both of these variants and equivalent structures.

To facilitate a complete understanding of the claimed invention, an overview of thermal inkjet technology will now be provided. A representative ink delivery system in the form of a thermal inkjet cartridge unit is illustrated in FIG. 1 at reference number 10. It shall be understood that cartridge 10 is presented herein for example purposes only and is non-limiting. Cartridge 10 is shown in schematic format in FIG. 1, with more detailed information regarding cartridge 10 and its various features (as well as similar systems) being provided in U.S. Pat. No. 4,500,895 to Buck et al.; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

With continued reference to FIG. 1, the cartridge 10 first includes an ink containment vessel 11 in the form of a housing 12. As noted above, the housing 12 shall constitute the ink storage unit of the invention, with the terms "ink containment unit", "ink storage unit", "housing", "vessel", and "tank" all being considered equivalent from a functional and structural standpoint. The housing 12 further comprises a top wall 16, a bottom wall 18, a first side panel 20, and a second side panel 22. In the embodiment of FIG. 1, the top wall 16 and the bottom wall 18 are substantially parallel to each other. Likewise, the first side panel 20 and the second side panel 22 are also substantially parallel to each other.

The housing 12 additionally includes a front wall 24 and a rear wall 26 which is optimally parallel to the front wall 24 as illustrated. Surrounded by the front wall 24, rear wall 26, top wall 16, bottom wall 18, first side panel 20, and second side panel 22 is an interior chamber or compartment 30 within the housing 12 (shown in phantom lines in FIG. 1) which is designed to retain a supply of an ink composition 32 therein that is either in unconstrained (e.g. "free-flowing") form or retained within a multicellular foam-type structure. Many different materials may be employed in connection with the ink composition 32 without limitation. The claimed invention is therefore not "ink-specific". The ink compositions will first contain at least one coloring agent. Again, this invention shall not be restricted to any particular coloring agents or mixtures thereof. While many different materials may be encompassed within the term "coloring agent", this discussion will focus on both colored and black dye products. Exemplary black dyes that are suitable for use in the ink compositions of interest are listed in U.S. Pat. No. 4,963,189 to Hindagolla which is incorporated herein by reference. Representative colored dye materials are described in the *Color Index,* Vol. 4, 3rd ed., published by The Society of Dyers and Colourists, Yorkshire, England (1971) which is also incorporated herein by reference and is a standard text that is well known in the art. Exemplary chemical dyes listed in the *Color Index,* supra, that are suitable for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61:1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, C.I. Basic Yellow 13, C.I. Basic Yellow 60, C.I. Basic Yellow 82, C.I. Basic Blue 124, C.I. Basic Blue 140, C.I. Basic Blue 154, C.I. Basic Red 14, C.I. Basic Red 46, C.I. Basic Red 51, C.I. Basic Black 11, and mixtures thereof. These materials are commercially available from many sources including but not limited to the Sandoz Corporation of East Hanover, N.J. (USA), Ciba-Geigy of Ardsley, N.Y. (USA), and others.

The term "coloring agent" shall also encompass pigment dispersions known in the art which basically involve a water-insoluble colorant (namely, a pigment) which is rendered soluble through association with a dispersant (e.g. an acrylic compound). Specific pigments which may be employed to produce pigment dispersions are known in the art, and the present invention shall not be limited to any particular chemical compositions in this regard. Examples of such pigments involve the following compounds which are listed in the *Color Index,* supra: C.I. Pigment Black 7, C.I. Pigment Blue 15, and C.I. Pigment Red 2. Dispersant materials suitable for combination with these and other pigments include monomers and polymers which are also known in the art. An exemplary commercial dispersant consists of a product sold by W. R. Grace and Co. of Lexington, Mass. (USA) under the trademark DAXAD. In a preferred and non-limiting embodiment, the ink compositions of interest will contain about 2–7% by weight total coloring agent therein (whether a single coloring agent or combined coloring agents are used). However, the amount of coloring agent to be employed may be varied as needed, depending on the ultimate purpose for which the ink composition is intended and the other ingredients in the ink.

The ink compositions suitable for use in this invention will also include an ink "vehicle" which essentially functions as a carrier medium and main solvent for the other ink components. Many different materials may be used as the ink vehicle, with the present invention not being limited to any particular products for this purpose. A preferred ink vehicle will consist of water combined with other ingredients (e.g. organic solvents and the like). These organic solvents include but are not limited to 2-pyrrolidone, 1,5-pentanediol, N-methyl pyrrolidone, 2-propanol, ethoxylated glycerol, 2-ethyl-2-hydroxymethyl-1,3-propanediol, cyclohexanol, and others known in the art for solvent and/or humectant purposes. All of these compounds may be used in various combinations as determined by preliminary pilot studies on the ink compositions of concern. However, in a preferred embodiment, the ink formulations will contain about 70–80% by weight total combined ink vehicle, wherein at least about 30% by weight of the total ink vehicle will typically consist of water (with the balance comprising any one of the above-listed organic solvents alone or combined). An exemplary ink vehicle will contain about 60–80% by weight water and about 10–30% by weight of one or more organic solvents.

The ink compositions may also include a number of optional ingredients in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID by Union Carbide of Danbury, Conn. (USA); and NUOSEPT by Huls America, Inc. of Piscataway, N.J. (USA). In a preferred embodiment, if a biocide is used, the final ink composition will typically include about 0.05–0.5% by weight biocide, with about 0.30% by weight being preferred.

Another optional ingredient to be employed in the ink compositions will involve one or more buffering agents. The use of a selected buffering agent or multiple (combined) buffering agents is designed to stabilize the pH of the ink formulations if needed and desired. In a preferred embodiment, the optimum pH of the ink compositions will range from about 4–9. Exemplary buffering agents suitable for this purpose include sodium borate, boric acid, and phosphate buffering materials known in the art for pH control. The selection of any particular buffering agents and the amount of buffering agents to be used (as well as the decision to use buffering agents in general) will be determined in accordance with preliminary pilot studies on the particular ink compositions of concern. Additional ingredients (e.g. surfactants) may also be present in the ink compositions if necessary. Again, many other ink materials may be employed as the ink composition 32 including those recited in U.S. Pat. No. 5,185,034 which is also incorporated herein by reference.

Referring back to FIG. 1, the front wall 24 also includes an externally-positioned, outwardly-extending printhead support structure 34 which comprises a substantially rectangular central cavity 50. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54. Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to the housing 12 of the ink cartridge 10 (e.g. attached to the outwardly-extending printhead support structure 34) is a printhead generally designated in FIG. 1 at reference number 80. While the novel features of the printhead 80 will be specifically discussed in the next section, a brief overview of the printhead 80 will now be provided for background information purposes. In accordance with conventional terminology, the printhead 80 actually comprises two main components fixedly secured together (with certain subcomponents positioned therebetween which are also of considerable importance). The first main component used to produce the printhead 80 consists of a substrate 82 (which functions as a "support structure" for the resistor elements as discussed further below). The substrate 82 is preferably manufactured from a number of materials without limitation including silicon [Si], silicon nitride [$Si_3N_4$] having a layer of silicon carbide [SiC] thereon, alumina [$Al_2O_3$], various metals (e.g. elemental aluminum [Al]), and the like. Secured to the upper surface 84 of the substrate 82 in the conventional printhead 80 of FIG. 1 using standard thin film fabrication techniques is at least one and preferably a plurality of individually-energizable thin-film resistors 86 (also designated herein as "resistor elements") which function as "ink ejectors". Alternatively, the resistors 86 may be affixed to at least one insulating layer which is pre-formed on the substrate 82 as discussed in the next section (Section "B") and illustrated in FIG. 4. However, for the sake of clarity and convenience in this section of the current discussion, the resistors 86 will be shown directly on the substrate 82 in FIG. 1.

In accordance with conventional thermal inkjet technology, the resistors 86 may be fabricated from a number of different materials including but not limited to doped polycrystalline silicon [Si], tantalum nitride [$Ta_2N$], nichrome [NiCr], hafnium bromide [$HfBr_4$], elemental niobium [Nb], elemental vanadium [V], elemental hafnium [Hf], elemental titanium [Ti], elemental zirconium [Zr], elemental yttrium [Y], mixtures thereof, or other comparable materials. However, as will become readily apparent from the information provided below, the present invention is primarily concerned with the use of doped polycrystalline silicon to fabricate the resistors 86 in view of its highly resistive character, cost-effectiveness, and other related factors.

Only a small number of resistors 86 are shown in the schematic representation of FIG. 1, with the resistors 86 being presented in enlarged format for the sake of clarity. A number of important material layers may likewise be present above and below the resistors 86 which shall be fully described in Section "B". Also provided on the upper surface 84 of the substrate 82 using standard photolithographic thin-film techniques is a plurality of metallic conductive traces 90 typically produced from copper [Cu], aluminum [Al], gold [Au], mixtures/alloys thereof, or other materials as outlined in Section "C". The conductive traces 90 (which are likewise schematically illustrated in enlarged format in FIG. 1) are also designated herein as "bus members", "elongate conductive circuit elements", "interconnect structures", "interconnect components", or simply "circuit elements" which electrically communicate with the resistors 86. In the conventional embodiment of FIG. 1, the circuit elements 90 likewise communicate with multiple metallic pad-like contact regions 92 positioned at the ends 94, 95 of the substrate 82 on the upper surface 84 which may be made from the same materials as the circuit elements 90 identified above. Alternatively, as discussed in U.S. Pat. No. 5,122,812 to Hess et al. the pad-like contact regions may be operatively connected to drive elements (e.g. transistors of the MOSFET ["metal oxide semiconductor field effect transistor"] variety or other types) which are directly located on the substrate 82. In this regard, the present invention shall not be restricted to any particular components or drive/control systems which may be attached to the interconnect structures (e.g. circuit elements 90) at the ends thereof opposite the resistors 86. The function of all these components which, in combination, are collectively designated herein as a "resistor assembly" 96 will be summarized further below. However, it should be noted that only a small number of circuit elements 90 are illustrated in the schematic representation of FIG. 1 which are again presented in enlarged format for the sake of clarity. Likewise, while the resistors 86 are shown schematically in a simplified "square" configuration in all of the accompanying drawing figures, it shall be understood that they may be formed in many different shapes, sizes, and designs ranging from those presented in FIG. 1 to "split", elongate, and/or "snake-like" structures. This configurational diversity shall likewise be applicable to the resistors of the present invention which, as previously noted, will be discussed extensively in Section "C".

Many different materials and design configurations can be used to construct the resistor assembly 96, with the present invention not being restricted to any particular elements, materials, and structures for this purpose unless otherwise indicated herein (e.g. see Section "C"). However, in a preferred, representative, and non-limiting embodiment, the resistor assembly 96 will be approximately 0.5 inches long, and will likewise contain about 300 resistors 86 thus enabling a resolution of about 600 dots per inch ("DPI"). These values may be varied in a non-limiting fashion, with the novel resistor systems of the present invention described herein enabling the production of a printhead having about 600–1200 resistors therein, with a print resolution of about 1200 dpi (e.g. a "true" 1200 dpi or at least two or more rows of 600 dpi resistors set at a 1200 dpi pitch).

The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86. It should also be noted that the substrate 82 may again include a number of other components thereon (not shown) depending on the type of ink cartridge 10 under consideration. For example, the substrate 82 may likewise comprise a plurality of logic transistors for precisely controlling operation of the resistors 86, as well as a "demultiplexer"of conventional configuration as discussed in U.S. Pat. No. 5,278,584. The demultiplexer is used to demultiplex incoming multiplexed signals and thereafter distribute these signals to the various resistors 86. The use of a demultiplexer for this purpose enables a reduction in the complexity and quantity of the circuitry (e.g. contact regions 92 and circuit elements 90) formed on the substrate 82.

Securely affixed to the substrate 82 (with the resistors 86 and a number of intervening material layers therebetween including an ink barrier layer as outlined in the next section) is the second main component of the printhead 80. Specifically, an orifice plate 104 is provided as shown in FIG. 1 which is used to distribute the selected ink compositions to a designated print media material (e.g. paper). In general, the orifice plate 104 consists of a panel member 106 (illustrated schematically in FIG. 1) which is manufactured from one or more metal compositions (e.g. gold-plated nickel [Ni] and the like). In a typical and non-limiting representative embodiment, the orifice plate 104 will have a length "L" of about 5–30 mm and a width "$W_1$" of about 3–15 mm. However, the claimed invention shall not be restricted to any particular orifice plate parameters unless otherwise indicated herein.

The orifice plate 104 further comprises at least one and preferably a plurality of openings (namely, "orifices") therethrough which are designated at reference number 108. These orifices 108 are shown in enlarged format in FIG. 1. Each orifice 108 in a representative embodiment will have a diameter of about 0.01–0.05 mm. In the completed printhead 80, all of the components listed above are assembled so that each orifice 108 is partially or (preferably) completely in axial alignment (e.g. in substantial "registry") with at least one of the resistors 86 on the substrate 82 and vice versa. As a result, energization of a given resistor 86 will cause ink expulsion through the desired orifice 108. The claimed invention shall not be limited to any particular size, shape, or dimensional characteristics in connection with the orifice plate 104 and shall likewise not be restricted to any number or arrangement of orifices 108. In the representative embodiment presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further general information concerning this type of metallic orifice plate system is provided in, for example, U.S. Pat. No. 4,500,895 to Buck et al. which is incorporated herein by reference.

It should also be noted for background purposes that, in addition to the systems discussed above which involve metal orifice plates, alternative printing units have effectively employed orifice plate structures constructed from non-metallic organic polymer compositions. These structures typically have an exemplary and non-limiting thickness of about 1.0–2.0 mils. In this context, the term "non-metallic" will encompass a product which does not contain any elemental metals, metal alloys, or metal amalgams/mixtures. The phrase "organic polymer" wherever it is used in the Detailed Description of Preferred Embodiments section shall involve a long-chain carbon-containing structure of repeating chemical subunits. A number of different polymeric compositions may be employed for orifice plate fabrication. For example, non-metallic orifice plate members can be manufactured from the following compositions: polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by E. I. du Pont de Nemours & Company of Wilmington, Del. (USA). Further data regarding the use of non-metallic organic polymer orifice plate systems is provided in U.S. Pat. No. 5,278,584 (incorporated herein by reference). Likewise, other orifice-containing structures may also be employed in addition to those outlined in this section including those which use the printhead barrier layer as the orifice-containing structure. In such an embodiment, the barrier layer would constitute a layer of material having at least one opening therein that would effectively function as an orifice plate/structure.

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with non-limiting examples including polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing the flexible circuit member 118 is a product sold under the trademark "KAPTON" by E. I. du Pont de Nemours & Company of Wilmington, Del. (USA) as previously noted. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit to the resistors 86 on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 in the embodiment of FIG. 1 come in contact with corresponding printer electrodes in order to transmit electrical control signals or "impulses" from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals or impulses from the printer unit can then travel via the elongate conductive circuit elements 90 on the substrate 82 to the resistors 86 so that on-demand heating (energization) of the resistors 86 can occur.

It is important to emphasize that the present invention shall not be restricted to the specific printhead 80 illustrated in FIG. 1 and discussed above (which is shown in abbreviated, schematic format), with many other printhead designs also being suitable for use in accordance with the invention. The printhead 80 of FIG. 1 is again provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The last major step in producing the completed printhead 80 involves physical attachment of the orifice plate 104 in position on the underlying portions of the printhead 80 (including the ink barrier layer as discussed below) so that the orifices 108 are in partial or complete axial alignment with the resistors 86 on the substrate 82 and vice versa. Attachment of these components may likewise be accomplished through the use of conventional adhesive materials (e.g. epoxy and/or cyanoacrylate adhesives known in the art for this purpose) as again outlined in further detail below. At this stage, construction of the ink cartridge 10 is completed. The ink composition 32 may then be delivered on-demand to a selected print media material 150 in order to generate a printed image 152 thereon. Many different compositions can be employed in connection with the print media material 150 including but not limited to paper, plastic (e.g. polyethylene terephthalate and other comparable polymeric compounds), metal, glass, and the like. Furthermore, the cartridge 10 may be deployed or otherwise positioned within a suitable printer unit 160 (FIG. 1) which delivers electrical impulses/signals to the cartridge unit 10 so that on-demand printing of the image 152 can take place. Many different printer units can be employed in connection with the ink delivery systems of the claimed invention (including cartridge 10) without restriction. However, exemplary printer units which are suitable for use with the printheads and ink delivery systems of the present invention include but are not limited to those manufactured and sold by the Hewlett-Packard Company of Palo Alto, Calif. (USA) under the following product designations: DESKJET 400C, 500C, 540C, 660C, 693C, 820C, 850C, 870C, 1200C, and 1600C.

Figure 2:
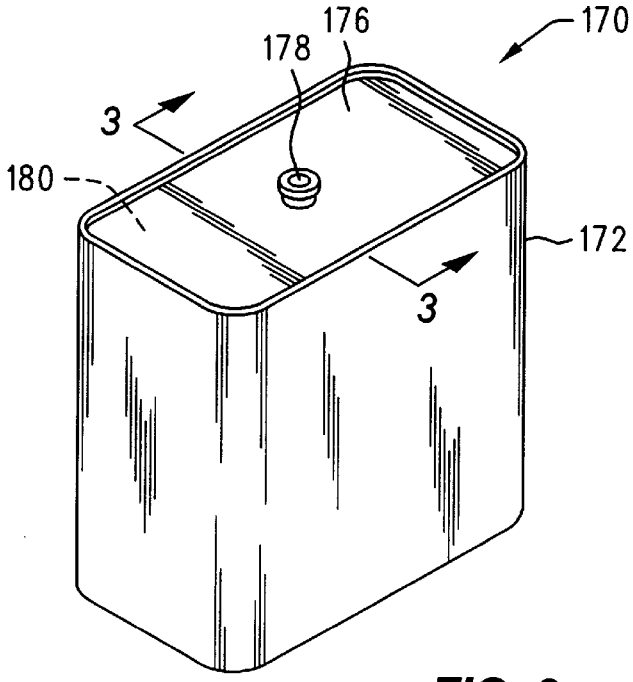
FIG. 2 is a schematically-illustrated perspective view of an ink containment vessel used in an alternative "off-axis"-type ink delivery system which may likewise be operatively connected to the printheads of the invention.
Figure 3:
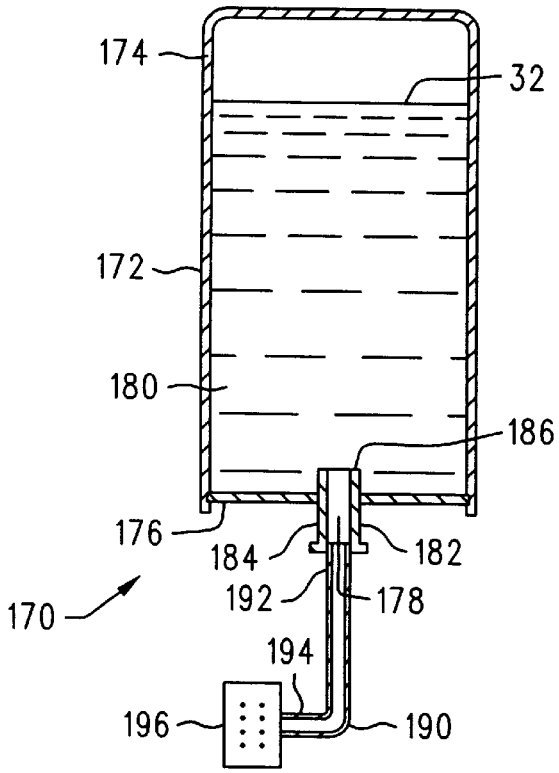
FIG. 3 is a partial cross-sectional view of the ink containment vessel shown in FIG. 2 taken along line 3—3.

The ink cartridge 10 discussed above in connection with FIG. 1 involves a "self-contained" ink delivery system which includes an "on-board" ink supply. The claimed invention may likewise be used with other systems which employ a printhead and a supply of ink stored within an ink containment vessel that is remotely spaced but operatively connected to and in fluid communication with the printhead. Fluid communication is typically accomplished using one or more tubular conduits. An example of such a system (which is known as an "off-axis" apparatus) is again disclosed in co-owned U.S. patent application Ser. No. 08/869,446 (filed on Jun. 5, 1997) and now U.S. Pat. No. 6,158,852 entitled "AN INK CONTAINMENT SYSTEM INCLUDING A PLURAL-WALLED BAG FORMED OF INNER AND OUTER FILM LAYERS" (Olsen et al.) and co-owned U.S. patent application Ser. No. 08/873,612 (filed Jun. 11, 1997) and now U.S. Pat. No. 5,975,686 entitled "REGULATOR FOR A FREE-INK INKJET PEN" (Hauck et al.) which are both incorporated herein by reference. As illustrated in FIGS. 2–3, a representative off-axis ink delivery system is shown which includes a tank-like ink containment vessel 170 that is designed for remote operative connection (preferably on a gravity feed or other comparable basis) to a selected thermal inkjet printhead. Again, the terms "ink containment unit", "ink storage unit", "vessel", "housing", and "tank" shall be considered equivalent in this embodiment. The ink containment vessel 170 is configured in the form of an outer shell or housing 172 which includes a main body portion 174 and a panel member 176 having an inlet/outlet port 178 passing therethrough (FIGS. 2–3). While this embodiment shall not be restricted to any particular assembly methods in connection with the housing 172, the panel member 176 is optimally produced as a separate structure from the main body portion 174. The panel member 176 is thereafter secured to the main body portion 174 as illustrated in FIG. 3 using known thermal welding processes or conventional adhesives (e.g. epoxy resin or cyanoacrylate compounds). However, the panel member 176 shall, in a preferred embodiment, be considered part of the overall ink containment vessel 170/housing 172.

With continued reference to FIG. 3, the housing 172 also has an internal chamber or cavity 180 therein for storing a supply of an ink composition 32. In addition, the housing 172 further includes an outwardly-extending tubular member 182 which passes through the panel member 176 and, in a preferred embodiment, is integrally formed therein. The term "tubular" as used throughout this description shall be defined to encompass a structure which includes at least one or more central passageways therethrough that are surrounded by an outer wall. The tubular member 182 incorporates the inlet/outlet port 178 therein as illustrated in FIG. 3 which provides access to the internal cavity 180 inside the housing 172.

The tubular member 182 positioned within the panel member 176 of the housing 172 has an outer section 184 which is located outside of the housing 172 and an inner section 186 that is located within the ink composition 32 in the internal cavity 180 (FIG. 3.) The outer section 184 of the tubular member 182 is operatively attached by adhesive materials (e.g. conventional cyanoacrylate or epoxy compounds), frictional engagement, and the like to a tubular ink transfer conduit 190 positioned within the port 178 shown schematically in FIG. 3. In the embodiment of FIG. 3, the ink transfer conduit 190 includes a first end 192 which is attached using the methods listed above to and within the port 178 in the outer section 184 of the tubular member 182. The ink transfer conduit 190 further includes a second end 194 that is operatively and remotely attached to a printhead 196 which may involve a number of different designs, configurations, and systems including those associated with printhead 80 illustrated in FIG. 1 which shall be considered equivalent to printhead 196. All of these components are appropriately mounted within a selected printer unit (including printer unit 160) at predetermined locations therein, depending on the type, size, and overall configuration of the entire ink delivery system. It should also be noted that the ink transfer conduit 190 may. include at least one optional in-line pump of conventional design (not shown) for facilitating the transfer of ink.

The systems and components presented in FIGS. 1–4 are illustrative in nature. They may, in fact, include additional operating components depending on the particular devices under consideration. The information provided above shall not limit or restrict the present invention and its various embodiments. Instead, the systems of FIGS. 1–4 may be varied as needed and are presented entirely to demonstrate the applicability of the claimed invention to ink delivery units which employ many different arrangements of components. In this regard, any discussion of particular ink delivery systems, ink containment vessels, and related data shall be considered representative only.

B. A General Review of the Resistor Elements and Associated Structures within a Conventional Printhead This section will provide a comprehensive discussion for background information purposes of the internal portions of a typical/conventional printhead (including the printhead 80 discussed above) with particular reference to the heating resistors and the interconnect structures attached thereto. The following description shall not limit the invention in any respect and is provided for example purposes only. Likewise, it shall again be understood that the present invention as described in subsequent sections of this discussion is prospectively applicable to a wide variety of different thermal inkjet systems and printhead units provided that, at a minimum, they include a support structure and at least one resistor element thereon which is used to selectively heat ink compositions for delivery to a print media material.

Figure 4:
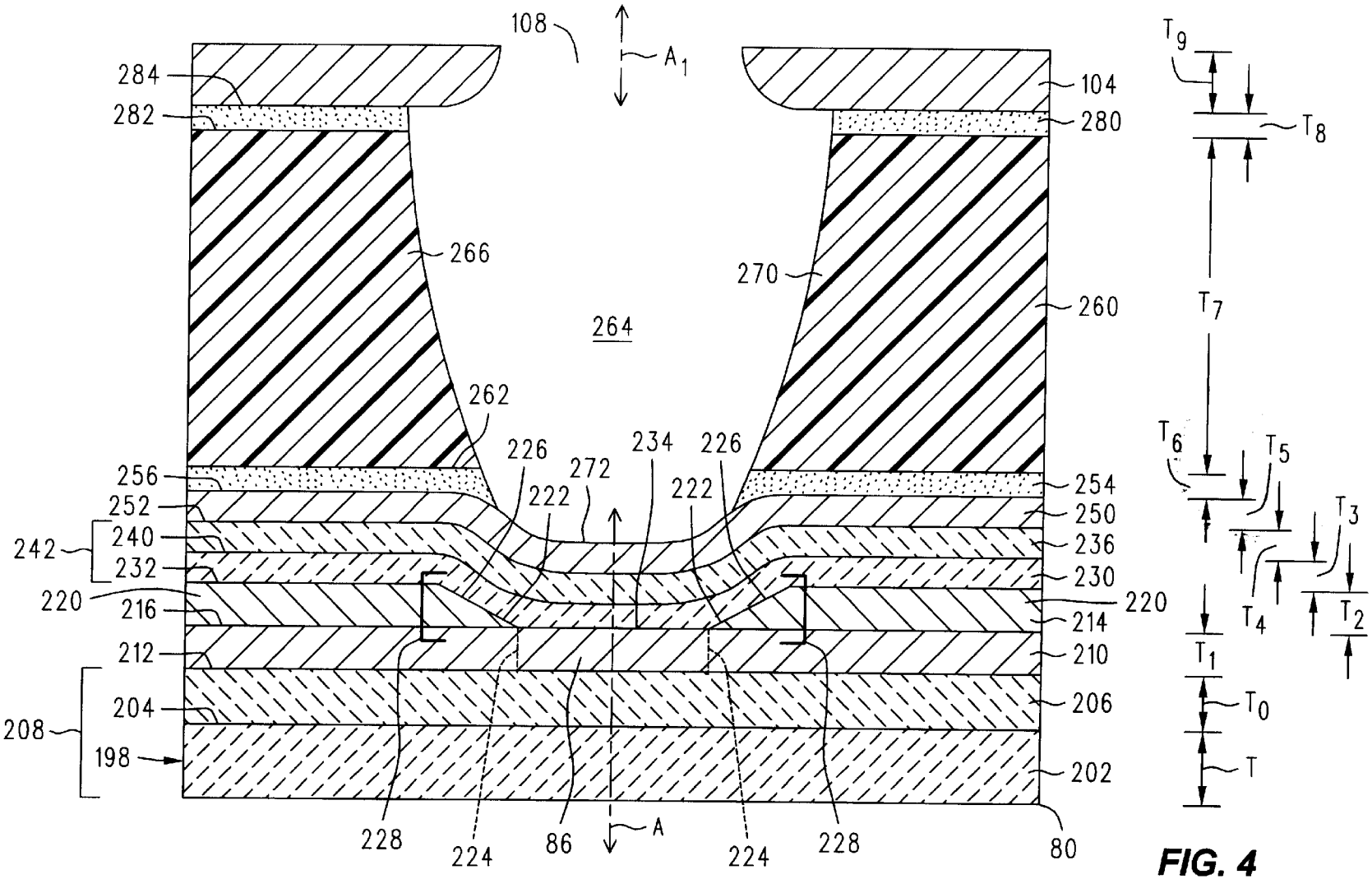
FIG. 4 (PRIOR ART)
FIG. 4 is a schematically-illustrated, enlarged cross-sectional view of the circled region in FIG. 1 (in an assembled format) taken along line 4—4. This figure illustrates the components of a conventional thermal inkjet printhead system with particular reference to a selected heating resistor and the interconnect structures associated therewith.

With reference to FIG. 4, a portion 198 of the printhead 80 is cross-sectionally illustrated. For reference purposes, the portion 198 involves the components and structures encompassed within the circled region 200 presented in FIG. 1. The components illustrated in FIG. 4 are shown in an assembled configuration. Likewise, it shall be understood that the various layers provided in FIG. 4 are not necessarily drawn to scale and are enlarged for the sake of clarity. In accordance with the cross-sectional view of FIG. 4, a representative resistor 86 (also characterized herein as a "resistor element" as defined above) is schematically shown along with the various material layers which are positioned above and below the resistor 86 (including the orifice plate 104). All of these structures (and the other layers outlined in this section) are likewise illustrated and fully explained (along with applicable construction techniques) in the following patents which are incorporated herein by reference: U.S. Pat. No. 4,535,343 to Wright et al. and U.S. Pat. No. 5,122,812 to Hess et al. However, for the sake of clarity and in order to provide a fully enabling disclosure, the following additional information will now be presented.

With continued reference to FIG. 4, the printhead 80 (namely, portion 198) first includes a substrate 202 which is optimally produced from elemental silicon [Si]. The silicon employed for this purpose may be monocrystalline, polycrystalline, or amorphous. Other materials can be used in connection with the substrate 202 without limitation including but not limited to alumina [$Al_2O_3$], silicon nitride [$Si_3N_4$] having a layer of silicon carbide [SiC] thereon, various metals (e.g. elemental aluminum [Al]), and the like (along with mixtures of these compositions). In a preferred and representative embodiment, the substrate 202 will have a thickness "T" of about 500–925 $\mu$m, with this range (and all of the other ranges and numerical parameters presented herein being subject to change as needed in accordance with routine preliminary testing unless otherwise noted). The size of substrate 202 may vary substantially, depending on the type of printhead system under consideration. However, in a representative embodiment (and with reference to FIG. 1), the substrate 202 will have an exemplary width "W" of about 3–15 mm and length "$L_1$" of about 5–40 mm. Incidentally, the substrate 202 in FIG. 4 is equivalent to the substrate 82 discussed above in Section "A", with the substrate 82 being renumbered in this section for the sake of clarity.

Next, positioned on the upper surface 204 of the substrate 202 is an optional dielectric base layer 206 which is designed to electrically insulate the substrate 202 from the resistor 86 shown in FIG. 4. The term "dielectric" as conventionally used herein again involves a material which is an electrical insulator or in which an electric field can be maintained with minimum power dissipation.

In standard thermal inkjet systems, the base layer 206 is preferably made from silicon dioxide ($SiO_2$) which, as discussed in U.S. Pat. No. 5,122,812, was traditionally formed on the upper surface 204 of the substrate 202 when the substrate 202 was produced from silicon [Si]. The silicon dioxide used to form the base layer 206 was fabricated by heating the upper surface 204 to a temperature of about 600–1000° C. in a mixture of silane, oxygen, and argon. This process is further discussed in U.S. Pat. No. 4,513,298 to Scheu which is likewise incorporated herein by reference. Thermal oxidation processes and other basic layer formation techniques described herein including chemical vapor deposition (CVD), plasma-enhanced chemical vapor deposition (PECVD), low-pressure chemical vapor deposition (LPCVD), and masking/imaging processes used for layer definition/formation are well known in the art and described in a book entitled Elliott, D. J., *Integrated Circuit Fabrica-*

*tion Technology,* McGraw-Hill Book Company, New York (1982)—(ISBN No. 0-07-019238-3), pp. 1–40, 43–85, 125–143, 165–229, and 245–286 which is incorporated herein by reference for background information purposes. In a representative and non-limiting embodiment, the base layer 206 (if used) will have a thickness $T_0$ (FIG. 4) of about 10,000–24,000 Å as outlined in U.S. Pat. No. 5,122,812.

At this point, it shall be understood that the substrate 202 having the base layer 206 thereon will be collectively designated as a "support structure" 208, with the term "support structure" as used herein encompassing (1) the substrate 202 by itself if no base layer 206 is employed; and (2) the substrate 202 and any other materials thereon which form a composite structure on which the resistors 86 reside or are otherwise positioned. In this regard, the term "support structure" shall generally involve the layer or layers of materials (whatever they may be) on which the resistor elements are placed.

The remainder of the layers and fabrication stages associated with the printhead 80 as illustrated in FIG. 4 are likewise conventional in nature except as noted below (e.g. see Section "C") and again discussed in U.S. Pat. No. 4,535,343 to Wright et al.; and U.S. Pat. No. 5,122,812 to Hess et al. With continued reference to FIG. 4, a resistive layer 210 (also characterized herein as a "layer of resistive material") is provided which is positioned/formed on the support structure 208, namely, the upper surface 212 of the base layer 206 or directly on the upper surface 204 of the substrate 202 if the base layer 206 is not employed. In this regard, when it is stated that the resistive layer 210, the resistors 86 used in conventional systems, or the resistor elements of present invention are "positioned", "located", "placed", "oriented", "operatively attached", "operatively connected", "formed", and otherwise secured to the support structure 208, this shall encompass a number of situations. These situations include those in which (1) the resistive layer 210/resistors 86 are secured directly on and to the upper surface 204 of the substrate 202 without any intervening material layers therebetween; or (2) the resistive layer 210/resistors 86 are supported by the substrate 202 in which one or more intermediate material layers (e.g. the base layer 206 and any others) are nonetheless located between the substrate 202 and resistors 86/resistive layer 210. Both of these alternatives shall be considered equivalent and encompassed within the present claims. The resistive layer 210 is conventionally used to create or "form" the resistors in the system (including the resistor element 86 shown in the conventional design of FIG. 4), with the steps that are employed for this purpose being described later in this section. The resistive layer 210 (and resistor elements produced therefrom including resistor 86) will have a thickness "$T_1$" of about 250–10,000 Å in a typical and conventional thermal inkjet printhead.

A number of different materials have been used to fabricate the resistive layer 210 in standard printhead systems without limitation. For example, as previously noted, a representative composition suitable for this purpose includes but is not limited to a mixture of elemental aluminum [Al] and elemental tantalum [Ta] (e.g. "TaAl") which is known in the art for thin-film resistor fabrication as discussed in U.S. Pat. No. 5,122,812. This material is typically formed by sputtering a pressed powder target of aluminum and tantalum onto the upper surface 212 of the base layer 206 in the system of FIG. 4. In a preferred embodiment, the final mixture which is again designated hereinafter as "TaAl" consists of about 40–60 atomic (At.) % tantalum (about 50 At. %=optimum) and about 40–60 atomic (At.) % aluminum (about 50 At. %=optimum).

Other compositions which have been employed as resistive materials in the resistive layer 210 include the following exemplary and non-limiting substances: doped polycrystalline silicon [Si] (with a number of "dopants" being applicable including but not limited to phosphorous [P], boron [B], arsenic [Ar], antimony [An], and the like), tantalum nitride [$Ta_2N$], nichrome [NiCr], hafnium bromide [$HfBr_4$], elemental niobium [Nb], elemental vanadium [V], elemental hafnium [Hf], elemental titanium [Ti], elemental zirconium [Zr], elemental yttrium [Y], and mixtures thereof. In accordance with the information provided below in Section "C", the claimed invention is primarily (but not exclusively) concerned with the use of resistors 86 fabricated from doped polycrystalline silicon, with this material, the various types thereof, and details involving the doping process being discussed extensively in Section "C". The polycrystalline silicon resistors 86 and the specialized interconnection system associated therewith offer many benefits and improvements compared with the resistor systems employed in prior printheads (e.g. the structure of FIG. 4 and others). These benefits include cooler and more uniform internal temperature profiles, improved reliability, greater energy efficiency, and the like.

The resistive layer 210 in a conventional thermal inkjet printhead can be applied in position using a number of different technologies (depending on the resistive materials under consideration) ranging from sputtering processes when metal compositions are involved to the various deposition procedures (including low pressure chemical vapor deposition [LPCVD] methods) which are outlined above and discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286 which is again incorporated herein by reference. For example, as noted in U.S. Pat. No. 5,122,812, LPCVD ("low pressure chemical vapor deposition") technology is particularly appropriate for use in applying silicon as the resistive material within printhead 80.

A typical thermal inkjet printhead will contain up to about 300 individual resistors 86 (FIG. 1) or more, depending on the type and overall capacity of the printhead being produced. However, use of the novel resistors 86 associated with the present invention can result in a printhead structure with as many as about 600–1200 resistors 86 if needed and desired. Although the particular architecture associated with the individual resistors 86 (FIG. 1) in the printhead 80 may be varied considerably as needed in accordance with the type of ink delivery system under consideration, an exemplary "square" resistor 86 (produced from the resistive layer 210) will have a non-limiting length of about 5–100 $\mu$m and a width of about 5–100 $\mu$m. However, the claimed invention shall not be restricted to any given dimensions in connection with the resistors 86 in the printhead 80. Likewise, the resistors 86 should be capable of heating the ink composition 32 to a temperature of at least about 300° C. or higher, depending on the particular apparatus under consideration and the type of ink being delivered.

With continued reference to FIG. 4, formation of an individual resistor 86 from the resistive layer 210 in accordance with conventional thermal inkjet technology will now be described. Specifically, a conductive layer 214 is positioned on the upper surface 216 of the resistive layer 210. The conductive layer 214 as illustrated in FIG. 4 includes dual portions 220 that are separated from each other. The inner ends 222 of each portion 220 actually form the "boundaries" of the resistor 86 as will be outlined further below. The conductive layer 214 (and portions 220 thereof) are produced from at least one conductive metal placed directly on the upper surface 216 of the resistive layer 210 and patterned thereon using conventional photolithographic, sputtering, metal deposition, and other known techniques as generally discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. Representative metals (and mixtures thereof) which are suitable for producing the conductive layer 214 will be listed later in this section.

As previously noted and illustrated in FIG. 4, the conductive layer 214 (which is discussed in considerable detail in U.S. Pat. No. 5,122,812) includes dual portions 220 each having inner ends 222. The distance between the inner ends 222 defines the boundaries which create the resistor 86 shown in FIGS. 1 and 4. In particular, the resistor 86 consists of the section of resistive layer 210 that spans (e.g. is between) the inner ends 222 of the dual portions 220 of the conductive layer 214. The boundaries of the resistor 86 are shown in FIG. 4 at dashed vertical lines 224.

As stated in U.S. Pat. No. 5,122,812, the resistor 86 operates as a "conductive bridge" between the dual portions 220 of the conductive layer 214 and effectively links them together from an electrical standpoint. As a result, when electricity in the form of an electrical impulse or signal from the printer unit 160 (discussed above) passes through the "bridge" structure formed by the resistor 86, heat is generated in accordance with the resistive character of the materials which are used to fabricate the resistive layer 210/resistor 86. From a technical standpoint, the presence of the conductive layer 214 over the resistive layer 210 essentially defeats the ability of the resistive material (when covered) to generate significant amounts of heat. Specifically, the electrical current, flowing via the path of least resistance, will be confined to the conductive layer 214, thereby generating minimal thermal energy. Thus, the resistive layer 210 only effectively functions as a "resistor" (e.g. resistor 86) where it is "uncovered" between the dual portions 220 as illustrated in FIG. 4.

In addition, with continued reference to FIG. 4, the inner ends 222 of the conductive layer 214 which are produced using the conventional methods discussed above each traditionally have an angularly-sloped surface 226. This sloped surface 226 (which is directly adjacent to and in contact with the resistor 86) creates a non-planar region that is located between brackets 228 (FIG. 4) which is difficult to completely and effectively cover with the overlying protective/passivation layers in the system as outlined above. The presence of non-planar geometry within the regions of the printhead 80 adjacent the resistor 86 can increase the likelihood of defect formation in the subsequently-applied passivation layer(s) including cracks, pinholes, fissures and the like. Such defects can defeat the entire purpose of the passivation layer(s), thereby leading to undesired ink contact with the resistor 86 and chemical deterioration thereof. As discussed in considerable detail in Section "C", the present invention employs a novel interconnection system which, in a preferred embodiment, results in a substantially planar topography in the vicinity of the resistor 86, thereby avoiding the difficulties listed above. Likewise, as shown in FIG. 4, the conductive layer 214 (which is optimally produced from a single elemental metal or a combination of multiple elemental metals) directly contacts the resistor 86 which can cause numerous additional difficulties including "current crowding" as previously discussed, "hot spots" at the conductive layer 214/resistor 86 junction, electromigration, excessive temperatures, energy losses, and the like. The present invention effectively avoids these problems by isolating the main conductive layer of material (discussed below) from the resistor 86 and instead uses a conductive "bridge" composition made of at least one metal silicide to electrically "link" these components. As a result, the foregoing problems are avoided with a number of benefits being provided ranging from improved energy efficiency to reduced-temperature operation and increased reliability. This system and its significant advantages will be further discussed in the next section (Section "C").

Regarding the conventional system of FIG. 4, many different compositions can be used to fabricate the conductive layer 214 including but not limited to the following representative materials: elemental aluminum [Al], elemental gold [Au], elemental copper [Cu], elemental tungsten [W], elemental silicon [Si], and/or mixtures thereof. In addition (as outlined in U.S. Pat. No. 5,122,812), the conductive layer 214 may optionally be produced from a selected composition which is combined with various materials or "dopants" including elemental copper and/or elemental silicon (assuming that other compositions are employed as the primary component[s] in the conductive layer 214). If elemental aluminum is used as the main constituent in the conductive layer 214 (with elemental copper being added as a "dopant"), the copper is specifically designed to control problems associated with electromigration. If elemental silicon is used as an additive in an aluminum-based system (either alone or combined with copper), the silicon will effectively prevent side reactions between the aluminum and other silicon-containing layers in the system. An exemplary and preferred material which is typically used to produce the conductive layer 214 will contain about 95.5% by weight elemental aluminum, about 3.0% by weight elemental copper, and about 1.5% by weight elemental silicon. Regarding the overall thickness "$T_2$" of the conductive layer 214 (and dual portions 220 associated therewith as illustrated in the standard system of FIG. 4), a representative value suitable for this structure will be about 2000–10,000 Å. However, all of the information provided above including the preferred thickness ranges may be varied as needed in accordance with preliminary pilot testing involving the particular ink delivery system under consideration and its desired capabilities.

With continued reference to FIG. 4, a number of different layers can be placed in position over the resistor 86 without limitation. Accordingly, the following description shall involve only one type of conventional printhead which is being discussed for example purposes. Positioned over and above the dual portions 220 of the conductive layer 214 and the resistor 86 is an optional first passivation layer 230. Specifically, the first passivation layer 230 is placed/deposited directly on (1) the upper surface 232 of each portion 220 associated with the conductive layer 214; and (2) the upper surface 234 of the resistor 86. The main function of the first passivation layer 230 (if used as determined by preliminary pilot testing) is to protect the resistor 86 (and the other components listed above) from the corrosive effects of the ink composition 32 used in the cartridge 10. The protective function of the first passivation layer 230 is of particular importance to the integrity of the resistor 86 since any physical damage to this structure can dramatically impair its basic operational capabilities. A number of different materials can be employed in connection with the first passivation layer 230 including but not limited to silicon dioxide [$SiO_2$], silicon nitride [$Si_3N_4$], aluminum oxide

[$Al_2O_3$], and silicon carbide [SiC]. In a preferred embodiment, silicon nitride is used which is optimally applied using plasma-enhanced chemical vapor deposition (PECVD) techniques to deliver the silicon nitride to the upper surface 232 of each portion 220 associated with the conductive layer 214, and the upper surface 234 of the resistor 86. This may be accomplished by using a conventional PECVD system to apply silicon nitride resulting from the decomposition of silane mixed with ammonia at a pressure of about 2 torr and temperature of about 300–400° C. as discussed in U.S. Pat. No. 5,122,812 which is again incorporated herein by reference. While the claimed invention shall not be restricted or otherwise limited to passivation layers 230 made from any given construction materials, the compounds listed above provide best results. Likewise, an exemplary thickness "$T_3$" associated with the first passivation layer 230 is about 1000–10,000 Å. This value may nonetheless be varied in accordance with routine preliminary testing involving the particular printhead system under consideration.

Next, in a preferred embodiment designed to provide a maximum degree of protective capability, an optional second passivation layer 236 is positioned directly on the upper surface 240 of the first passivation layer 230 discussed above. The second passivation layer 236 (the use of which shall again be determined by preliminary pilot testing) is preferably manufactured from silicon carbide [SiC], although silicon nitride [$Si_3N_4$], silicon dioxide [$SiO_2$], or aluminum oxide [$Al_2O_3$] may also be employed for this purpose. While a number of different techniques can be used to deposit the second passivation layer 236 on the first passivation layer 230 (as is the case with all of the various material layers discussed herein), plasma-enhanced chemical vapor deposition techniques (PECVD) provide optimal results at this stage. If silicon carbide is involved, for example, the PECVD process is accomplished in a representative embodiment by using a combination of silane and methane at a temperature of about 300–450° C. The second passivation layer 236 is again employed to augment the protective capabilities of the first passivation layer 230 by providing an additional chemical barrier to the corrosive effects of the ink composition 32 as previously noted. While the claimed invention shall not be restricted to any particular dimensions in connection with the second passivation layer 236, a representative thickness "$T_4$" for this structure is about 1000–10,000 Å. As a result, a highly-effective "dual passivation structure" 242 is created which consists of (1) the first passivation layer 230; and (2) the second passivation layer 236.

With continued reference to FIG. 4, the next layer in the representative printhead 80 involves an optional electrically conductive anti-cavitation layer 250 which is applied to the upper surface 252 of the second passivation layer 236. The anti-cavitation layer 250 (the use of which is again determined by preliminary pilot testing) provides an even further degree of protection regarding the underlying structures in the printhead 80. Specifically, it is used to impart physical damage resistance to the layers of material beneath the anti-cavitation layer 250 in the printhead 80 including but not limited to the first and second passivation layers 230, 236 and the resistor 86 thereunder. In accordance with the protective function of the anti-cavitation layer 250, it is optimally made from a selected metal including but not limited to the following preferred materials: elemental tantalum [Ta], elemental molybdenum [Mo], elemental tungsten [W], and mixtures/alloys thereof. While a number of different techniques can be employed for depositing the anti-cavitation layer 250 in position on the upper surface 252 of the second passivation layer 236 in the embodiment of FIG. 4, this step is optimally accomplished in accordance with standard sputtering methods and/or other applicable procedures as discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. Likewise, in a non-limiting exemplary embodiment designed to provide optimum results (which is subject to change in accordance with preliminary pilot testing involving the particular structures under consideration), the anti-cavitation layer 250 has a preferred thickness "$T_5$" of about 1000–6000 Å.

At this stage, a number of additional components are employed within the printhead 80 which will now be discussed with particular reference to FIG. 4. As illustrated in FIG. 4 and outlined in U.S. Pat. No. 4,535,343, an optional first adhesive layer 254 is applied in position on the upper surface 256 of the anti-cavitation layer 250 which may involve a number of different compositions without limitation. Representative materials suitable for this purpose include but are not limited to conventional epoxy resin materials, standard cyanoacrylate adhesives, silane coupling agents, and the like. The first adhesive layer 254 is again considered to be "optional" in that a number of the materials which may be employed in connection with the overlying barrier layer (described below) will be substantially "self-adhesive" relative to the anti-cavitation layer 250. A decision to use the first adhesive layer 254 shall therefore be determined in accordance with routine preliminary testing involving the particular printhead components under consideration. If used, the first adhesive layer 254 may be applied to the upper surface 256 of the anti-cavitation layer 250 by conventional processes including but not limited to spin coating, roll coating, and other known application materials which are appropriate for this purpose. While the first adhesive layer 254 may be optional in nature, it can be employed as a "default" measure for precautionary reasons to automatically ensure that the overlying barrier layer (discussed below) is securely retained in position. If, in fact, the first adhesive layer 254 is used, it will have an exemplary thickness "$T_6$" of about 100–1000 Å.

Next, a specialized composition is provided within the printhead 80 which is characterized herein as an ink barrier layer 260. The barrier layer 260 is applied in position on the upper surface 262 of the first adhesive layer 254 (if used) or on the upper surface 256 of the anti-cavitation layer 250 if the first adhesive layer 254 is not employed. The barrier layer 260 provides a number of important functions including but not limited to additional protection of the components thereunder from the corrosive effects of the ink composition 32 and the minimization of "cross-talk" between adjacent resistors 86 in the printing system. Of particular interest is the protective function of the barrier layer 260 which electrically insulates the circuit elements 90/resistors 86 (FIG. 1) from each other and other adjacent parts of the printhead 80 so that short circuits and physical damage to these components are prevented. In particular, the barrier layer 260 functions as an electrical insulator and "sealant" which covers the circuit elements 90 and prevents them from coming in contact with the ink materials (ink composition 32 in this embodiment). The barrier layer 260 also protects the components thereunder from physical shock and abrasion damage. These benefits ensure consistent and long-term operation of the printhead 80. Likewise, the architectural features and characteristics of the barrier layer 260 illustrated in FIG. 4 facilitate the precise formation of a discrete "firing chamber" 264 in the printhead 80. The firing chamber 264 involves the particular region within the printhead 80 where ink materials (namely, ink composition 32) are heated by the resistor 86, followed by bubble nucleation and expulsion onto the print media material 150.

Many different chemical compositions may be employed in connection with the ink barrier layer 260, with high-dielectric organic compounds (e.g. polymers or monomers) being preferred. Representative organic materials which are suitable for this purpose include but are not restricted to commercially-available acrylate photoresists, photoimagable polyimides, thermoplastic adhesives, and other comparable materials that are known in the art for ink barrier layer use. For example, the following representative, non-limiting compounds suitable for fabricating the ink barrier layer 260 are as follows: (1) dry photoresist films containing half acrylol esters of bis-phenol; (2) epoxy monomers; (3) acrylic and melamine monomers [e.g. those which are sold under the trademark "Vacrel" by E. I. DuPont de Nemours and Company of Wilmington, Del. (USA)]; and (4) epoxy-acrylate monomers [e.g. those which are sold under the trademark "Parad" by E. I. DuPont de Nemours and Company of Wilmington, Del. (USA)]. Further information regarding barrier materials is provided in U.S. Pat. No. 5,278,584 which is incorporated herein by reference. The claimed invention shall not be restricted to any particular barrier compositions or methods for applying the barrier layer 260 in position. Regarding preferred application methods, the barrier layer 260 is traditionally delivered by high speed centrifugal spin coating devices, spray coating units, roller coating systems, and the like. However, the particular application method for any given situation will depend on the barrier layer 260 under consideration.

With continued reference to FIG. 4, the barrier layer 260 as cross-sectionally illustrated in this figure consists of two sections 266, 270 which are spaced apart from each other in order to form the firing chamber 264 as discussed above. Positioned at the bottom 272 of the firing chamber 264 is the resistor 86 and layers thereon (including the first passivation layer 230, the second passivation layer 236, and the anti-cavitation layer 250). Heat is imparted to the ink materials (e.g. ink composition 32) within the firing chamber 264 from the resistor 86 through the above-listed layers 230, 236, and 250. While the ultimate thickness and architecture associated with the barrier layer 260 may be varied as needed based on the type of printhead being employed, it is preferred that the barrier layer 260 have a representative, non-limiting thickness "$T_7$" of about 5–30 $\mu$m.

Next, an optional second adhesive layer 280 is provided which is positioned on the upper surface 282 of the ink barrier layer 260. Representative materials suitable for use in connection with the second adhesive layer 280 include but are not limited to conventional epoxy resin materials, standard cyanoacrylate adhesives, silane coupling agents, and the like. The second adhesive layer 280 is again considered to be "optional" in that a number of the materials which may be employed in connection with the overlying orifice plate 104 (discussed below) will be substantially "self-adhesive" relative to the barrier layer 260. A decision to use the second adhesive layer 280 shall therefore be determined in accordance with routine preliminary testing involving the particular printhead components under consideration. If used, the second adhesive layer 280 may be applied to the upper surface 282 of the barrier layer 260 by conventional processes including but not limited to spin coating, roll coating, and other known application methods which are suitable for this purpose. While the second adhesive layer 280 may be optional in nature, it can be employed as a "default" measure for precautionary reasons to automatically ensure that the overlying orifice plate 104 is securely retained in position. If, in fact, the second adhesive layer 280 is used, it will have an exemplary thickness "$T_8$" of about 100–1000 Å.

It should also be noted that the second adhesive layer 280 may, in fact, involve the use of uncured poly-isoprene photoresist compounds as recited in U.S. Pat. No. 5,278,584 (incorporated herein by reference), as well as (1) polyacrylic acid; or (2) a selected silane coupling agent. The term "polyacrylic acid" shall be defined to involve a compound having the following basic chemical structure [$CH_2CH(COOH)_n$] wherein n=25–10,000. Polyacrylic acid is commercially available from numerous sources including but not limited to the Dow Chemical Corporation of Midland, Mich. (USA). A number of silane coupling agents which are suitable for use herein include but are not limited to commercial products sold by the Dow Chemical Corporation of Midland, Mich. (USA) [product nos. 6011, 6020, 6030, and 6040], as well as OSI Specialties of Danbury, Conn. (USA) [product no. "Silquest" A-1100]. However, the above-listed materials are again provided for example purposes only and shall not limit the invention in any respect.

Finally, as illustrated in FIG. 4, the orifice plate 104 is secured to the upper surface 284 of the second adhesive layer 280 or on the upper surface 282 of the barrier layer 260 if the second adhesive layer 280 is not employed. In addition to the various materials discussed above in connection with the orifice plate 104 (including the use of a structure made from gold-plated nickel [Ni]), a substantial number of additional compositions can be employed in connection with the orifice plate 104 including metallic structures made of, for example, elemental nickel [Ni] coated with elemental rhodium [Rh]. Likewise, the orifice plate 104 can be made from the polymeric compositions outlined in U.S. Pat. No. 5,278,584 (discussed above). As shown in FIG. 4 and previously noted, the orifice 108 in the orifice plate 104 is positioned above the resistor 86 and is in partial or (preferably) complete axial alignment (e.g. "registry") therewith so that ink compositions can be effectively expelled from the printhead 80. Likewise, in a preferred and non-limiting embodiment, the orifice plate 104 will have a representative thickness "$T_9$" of about 12–60 $\mu$m.

It should likewise be noted at this time that a number of different structures may be used in connection with the orifice plate 104, wherein the claimed invention shall encompass any single or multiple layers of material (made of metal, plastic, etc.) which include at least one opening or orifice therein without limitation. The orifice-containing layer (or layers) of material may be characterized as an "orifice plate", "orifice structure", "top layer", and the like. Furthermore, single or multiple layers of materials may again be employed for this purpose without restriction, with the terms "orifice plate", "orifice structure", etc. being defined to include both single and multi-layer embodiments. Thus, the term "layer" as employed in connection with this structure shall encompass both the singular and plural uses thereof. One additional example of an alternative orifice structure involves a situation in which the barrier layer 260 as shown in FIG. 4 is used by itself in the absence of the orifice plate 104 and adhesive layer 280. In other words, a barrier layer 260 is selected which can function as both an ink barrier material and an orifice plate.

Having discussed a conventional printhead 80 and its individual components, the resistor systems of the claimed invention will now be reviewed in detail. Specifically, the particular features of the invention which depart from the system outlined above will be described with particularity.

C. The Novel Resistor Systems of the Present Invention and Representative Fabrication Methods Associated Therewith The novel features and components of the present invention which enable it to provide the benefits listed above will now be discussed. These benefits again range from the minimization of "current crowding" as previously noted to improved long-term reliability and reduced internal printhead temperatures. All of these goals are achieved in an essentially "automatic" manner as described further below which is likewise compatible with the efficient manufacture of thermal inkjet printheads on a mass production scale. The claimed invention therefore constitutes a substantial advance in the art of ink printing technology which ensures high levels of operating efficiency, excellent print quality, and increased longevity.

To accomplish these goals, a novel and highly efficient resistor system is provided, with the term "resistor system" again being defined to collectively encompass the selected resistor elements and the interconnect structures associated therewith (circuit traces and the like). It shall be understood that reference numbers used in this section (Section "C") which are carried over from the other sections provided above (Sections "A"–"B") shall signify the use of common subject matter, components, and elements. Likewise, all of the information presented in the previous two sections (Sections "A"–"B") shall be incorporated by reference in the current section (Section "C") and should be considered applicable to the present invention unless otherwise stated herein. Identification of various elements below in the singular shall likewise be applicable to the use of a plurality of such elements as needed and desired. The novel subject matter associated with the present invention will be specifically identified in the current section and distinguished where appropriate from the prior system of FIG. 4. Likewise, the resistor system illustrated in the drawing figures subsequent to FIG. 4 shall be applicable to and capable of integration within the printheads 80, 196 of FIGS. 1, 3, and 4 in order to provide the benefits recited herein. However, the resistor system of this invention shall not be limited to use within printheads 80, 196 and is applicable to a wide variety of different printheads using dissimilar architectural and structural features without limitation.

Figure 20:
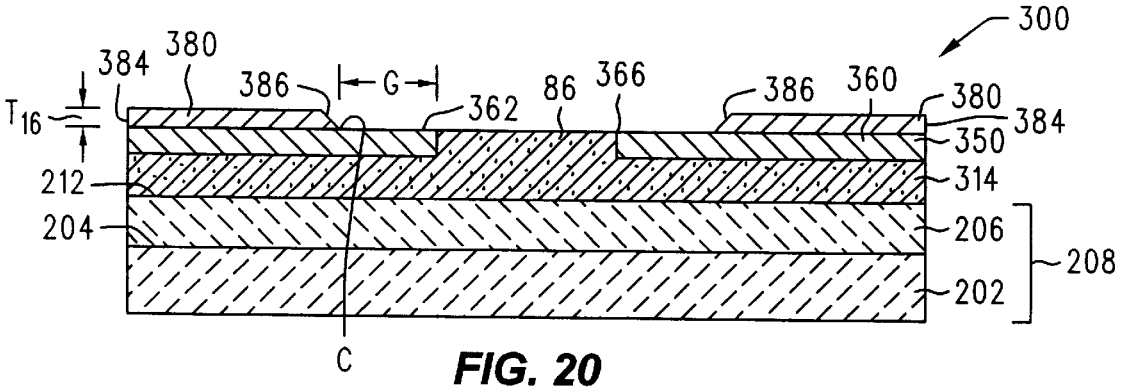

Production of the claimed resistor system shall now be described in a sequential manner leading up to completion of the final product as shown in FIG. 20 at reference number 300. However, the invention described herein shall not be restricted to any specific manufacturing methods, with the resistor system 300 not being "production-method-specific". Instead, a number of different fabrication techniques can be employed without limitation provided that they produce the final resistor system 300. Representative techniques, processing methods, and other production stages will now be discussed which are provided herein for example purposes only.

Figure 5:
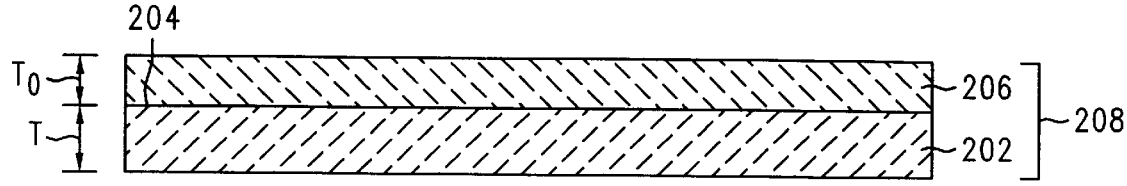
FIGS. 5–14, 16–18, and 20 involve a sequential, schematically-illustrated, enlarged cross-sectional view of the various components and production stages which are used to fabricate the claimed resistor elements and interconnect structures of the present invention in a primary or "main" embodiment. The completed product of FIG. 20 may be integrated into the printhead of FIG. 4 (as a replacement for the conventional structures shown therein).

With reference to FIG. 5, the substrate 202 described above is again illustrated which is optimally produced from elemental silicon [Si]. The silicon employed for this purpose may be monocrystalline, polycrystalline, or amorphous. Other materials can be used in connection with the substrate 202 without limitation including but not limited to alumina [$Al_2O_3$], silicon nitride [$Si_3N_4$] having a layer of silicon carbide [SiC] thereon, various metals (e.g. elemental aluminum [Al]), and the like (along with mixtures of these compositions). In a preferred and representative embodiment, the substrate 202 will again have a thickness "T" of about 500–925 $\mu$m (FIG. 4), with this range (and all of the other ranges and numerical parameters presented herein) being subject to change as needed in accordance with routine preliminary testing unless otherwise noted. The size of substrate 202 may vary substantially, depending on the type of printhead under consideration. However, in a representative embodiment (and with reference to FIG. 1), the substrate 202 will have an exemplary width "W" of about 3–15 mm and length "$L_1$" of about 5–40 mm. Incidentally, the substrate 202 in FIGS. 4–5 is equivalent to the substrate 82 discussed above in Section "A", with the substrate 82 again being renumbered in this section for the sake of clarity.

Next, positioned on the upper surface 204 of the substrate 202 is an optional dielectric base layer 206 which is designed to electrically insulate the substrate 202 from the resistor 86 in the system which will be discussed later in this section. The term "dielectric" is defined above. In standard thermal inkjet systems, the base layer 206 is preferably made from silicon dioxide ($SiO_2$) which, as indicated in U.S. Pat. No. 5,122,812, was traditionally formed on the upper surface 204 of the substrate 202 when the substrate 202 was produced from silicon [Si]. The silicon dioxide used to form the base layer 206 was fabricated by heating the upper surface 204 to a temperature of about 600–1000° C. in a mixture of silane, oxygen, and argon. This process is further discussed in U.S. Pat. No. 4,513,298 to Scheu which is likewise incorporated herein by reference. Thermal oxidation processes and other basic layer formation techniques that are suitable for use herein including chemical vapor deposition (CVD), plasma-enhanced chemical vapor deposition (PECVD), low-pressure chemical vapor deposition (LPCVD), and masking/imaging processes used for layer definition/formation are well known in the art and again described in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286 which is incorporated herein by reference. In a representative and non-limiting embodiment, the base layer 206 (if used) will have a thickness $T_0$ (FIG. 4) of about 10,000–24,000 Å as stated in U.S. Pat. No. 5,122,812.

At this point, it shall be understood that the substrate 202 having the base layer 206 thereon will be collectively designated in this discussion as a "support structure" 208 as previously noted, with the term "support structure" encompassing (1) the substrate 202 by itself if no base layer 206 is employed; or (2) the substrate 202 and any other materials thereon which form a composite structure on which the resistors 86 reside or are otherwise positioned. In this regard, the term "support structure" shall generally involve the layer or layers of materials (whatever they may be) on which the resistors 86 and interconnection components associated therewith are positioned.

Figure 6:
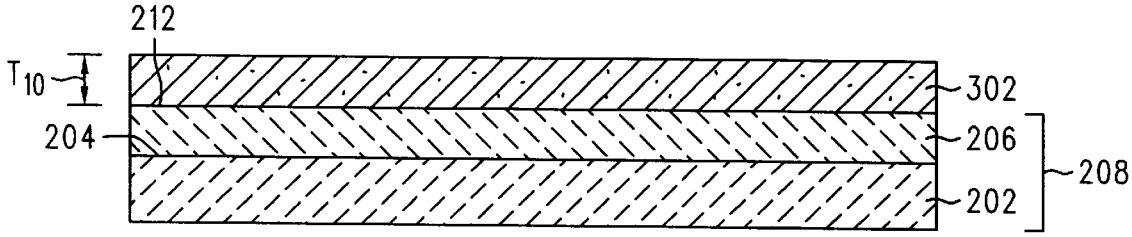

Next, as shown in FIG. 6, an initial layer 302 of silicon [Si] is placed (e.g. operatively attached) to the upper surface 212 of the base layer 206 (or the upper surface 204 of the substrate 202 if the base layer 206 is not employed). In a preferred embodiment which shall not limit the invention in any respect, the layer 302 of silicon shall be of the "amorphous" type which is a known silicon product that basically lacks a completely defined crystalline structure. This material may be applied in position using a number of different techniques including but not limited to chemical vapor deposition (CVD), plasma-enhanced chemical vapor deposition (PECVD), low-pressure chemical vapor deposition (LPCVD), or other comparable processes. Also employed are masking/imaging processes used for layer definition/formation that are again well known in the art and described in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. While the claimed invention is not restricted to any given dimensions and numerical parameters which shall be determined in accordance with routine preliminary pilot testing, the initial layer 302 of silicon preferably has a uniform thickness "$T_{10}$" (FIG. 6) of about 500–3000 Å.

Figure 7:
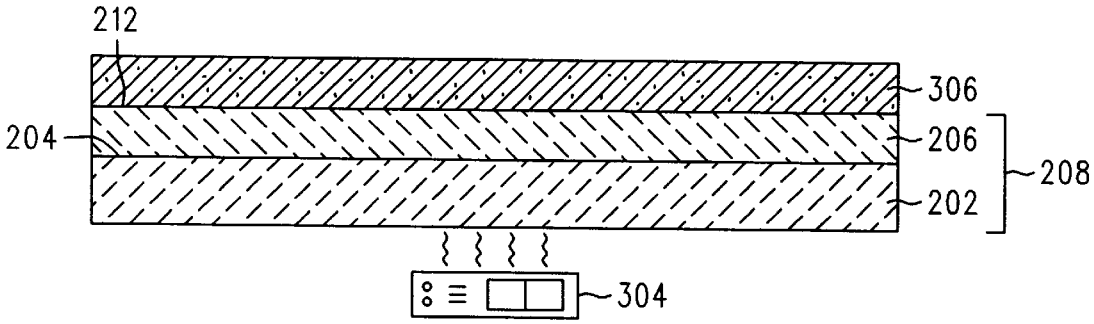

Thereafter, in accordance with FIG. 7, the initial layer 302 of silicon is "annealed" or otherwise heated using a conventional furnace apparatus 304 in order to convert it into a layer 306 of polycrystalline silicon. A representative and non-limiting annealing process will involve heating the initial layer 302 of silicon at a temperature of about 550–700° C. over a time period of about 8–20 hours to effectively accomplish conversion. The term "polycrystalline silicon" traditionally involves a silicon material containing an aggregate of multiple crystals. Other conversion processes may likewise be employed for this purpose including but not limited to the use of laser energy to heat the initial layer 302 of silicon. The ultimate goal at this stage is to fabricate a layer 306 of polycrystalline silicon having a very smooth surface and a relatively large grain/crystal size therein (with a preferred/typical grain size [diameter] of about 1–5 times the thickness of the initial layer 302 of silicon (e.g. "$T_{10}$" as noted above). In general, polycrystalline silicon is a preferred material for use in the present invention because it is a readily available material with stable and advantageous properties that is economical to use.

Figure 12:
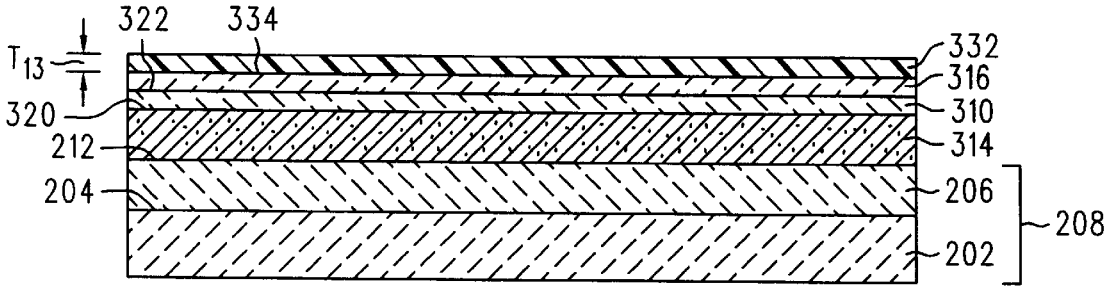

It should likewise be understood that, as an alternative to the sequential conversion process outlined above, the layer 306 of polycrystalline silicon could be applied in a single step using one of many techniques including but not limited to chemical vapor deposition (CVD), plasma-enhanced chemical vapor deposition (PECVD), and low-pressure chemical vapor deposition (LPCVD). Regarding any other deposition methods discussed in this section (Section "C"), the above-listed reference by Elliott, D. J. entitled *Integrated Circuit Fabrication Technology,* McGraw-Hill Book Company, New York (1982)—(ISBN No. 0-07-019238-3) may be employed for general guidance and support. However, the in situ method listed above (e.g. the conversion of previously-applied material layers) is preferred and provides best results. After this step, a number of different layers are applied which will now be discussed. Likewise, at this point, the layer 306 of polycrystalline silicon may be suitably patterned as needed and desired using conventional processes including those discussed in Elliott, D. J., *Integrated Circuit Fabrication Technology,* McGraw-Hill Book Company, New York (1982)—(ISBN No. 0-07-019238-3) as noted above. However, for the sake of clarity, the foregoing patterning stage(s) have been omitted with the understanding that they are conventional in nature. For reference purposes, the steps and techniques employed in connection with FIGS. 12–14 as discussed below may be used for preliminary patterning at this stage.

Figure 8:
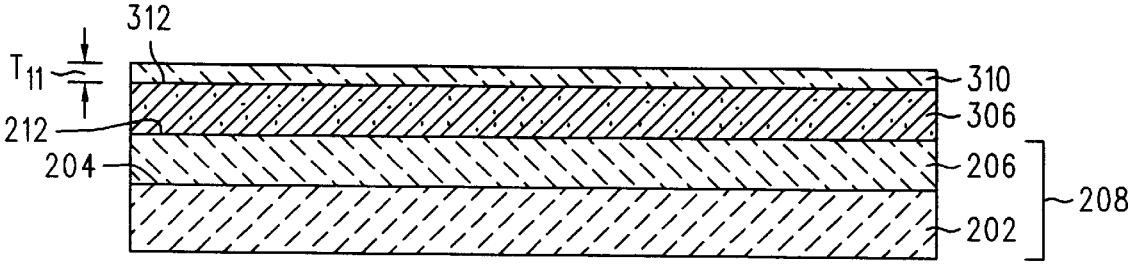

Next, as shown in FIG. 8, a layer 310 of a composition designated herein as tetraethyl orthosilicate (e.g. "TEOS") is provided which is deposited over the entire upper surface 312 of the layer 306 of polycrystalline silicon. This material is optimally applied using conventional plasma-enhanced chemical vapor deposition (PECVD) processes at a preferred and non-limiting uniform thickness "$T_{11}$" of about 100–300 Å. From a functional standpoint, the layer 310 of TEOS is used as a "stress-relief" oxide layer designed to preserve the structural integrity of the additional layers which will be subsequently applied as outlined below. It also protects the chemical integrity of the underlying layer 306 of polycrystalline silicon. Furthermore, it is likewise employed as an "etch stop" layer during subsequent silicon nitride dry etching (discussed below).

Figure 9:
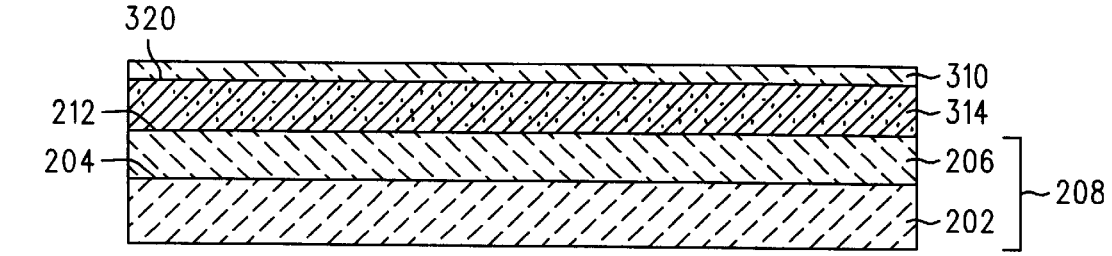

As shown in FIG. 9, the next step in the printhead fabrication process involves "doping" the polycrystalline silicon in the layer 306 of FIG. 7 in order to form a layer 314 of doped polycrystalline silicon. Many different methods may be employed for this purpose without limitation. Likewise, a number of different doped polycrystalline silicon materials can be used as previously discussed including phosphorous-doped polycrystalline silicon, boron-doped polycrystalline silicon, arsenic-doped polycrystalline silicon, antimony-doped polycrystalline silicon, and mixtures thereof. However, for example purposes, the doping process will be described herein with particular reference to phosphorous-doped polycrystalline silicon (the preferred material). Basically, doping (which is a well-known procedure) is accomplished by using a conventional ion-implantation apparatus which creates phosphorous ions from a phosphorous source (phosphine by way of example). These phosphorous ions are maintained at an energy level of about 40–60 KeV using the ion-implantation apparatus, with a phosphorous "dose" of about $1.0\times10^{15}$ phosphorous ions per $cm^2$. As a result of this process, the implantation/doping procedure occurs.

Regarding the production of other doped polycrystalline silicon materials which may be used in the layer 314 as listed herein, this may likewise be accomplished using the methodology described above except that the dopant source, ion energy levels, and "doses" are changed as needed and desired in accordance with routine preliminary testing. As a result of the foregoing doping procedures (which are again standard in nature), the desired "implant" material or "dopant" will be interspersed within the polycrystalline silicon structure of layer 314. A preferred and non-limiting "doping level" to be employed in this step which is applicable to all of the doped polycrystalline silicon materials used in the layer 314 as previously listed will involve about $10^{17}$–$10^{20}$ dopant atoms per $cm^3$, with the term "doping level" being defined to encompass the number of dopant atoms which are present in the layer 314 per $cm^3$ thereof. Likewise, in accordance with the oxide-based character of the TEOS material recited above which is present in the layer 310, doping may be accomplished in an effective manner directly through the layer 310 of TEOS without difficulty. It shall again be emphasized that the doping step(s) outlined in this section can be accomplished in many different ways including the use of techniques generally discussed in Elliott, D. J., *Integrated Circuit Fabrication Technology,* McGraw-Hill Book Company, New York (1982)—(ISBN No. 0-07-019238-3), pp. 13–18 (incorporated herein by reference). At this point, the ultimate goal of the foregoing procedure is to ideally achieve a resistivity associated with the layer 314 of doped polycrystalline silicon of about 4000–7000 $\mu\Omega$-cm with a "TCR" (e.g. "temperature coefficient of resistance") of about −200 to +200 ppm/° C. (wherein these values are subject to change and/or modification if needed and desired in accordance with routine preliminary pilot testing). The "temperature coefficient of resistance" of a substance is generally defined to involve the change in resistivity of a substance per unit change in temperature. Incidentally, the upper surface of the layer 314 of doped polycrystalline silicon is shown at reference number 320 in FIG. 10.

Figure 10:
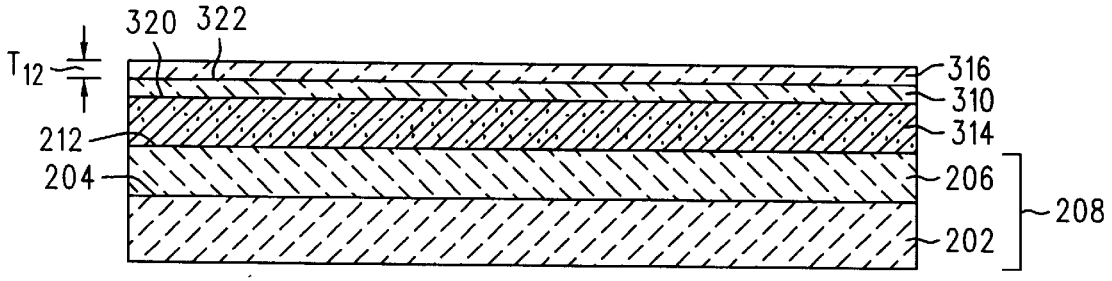

With reference to FIG. 10, the next step in the representative procedure being described in this section involves the application of a layer 316 of silicon nitride ($Si_3N_4$ or other stoichiometric variants of this formula) onto the entire upper surface 322 of the layer 310 of TEOS. This step may be achieved using many different techniques including but not limited to conventional low pressure chemical vapor deposition (LPCVD) and/or plasma-enhanced chemical vapor deposition (PECVD) methods at a preferred and non-limiting uniform thickness "$T_{12}$" of about 100–300 Å. From a functional standpoint, the layer 316 of silicon nitride is employed in order to form a "mask" over the region of the structure shown in FIG. 10 which will become the resistor 86 so that it may be properly protected and retain its separate character as outlined below.

Figure 11:
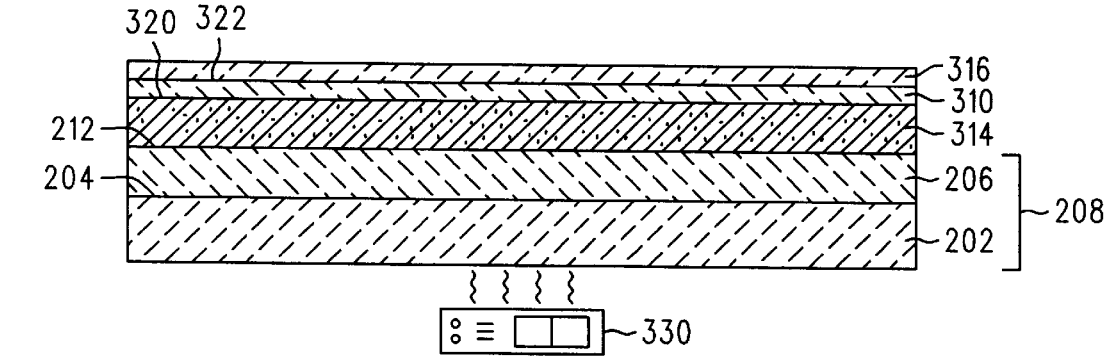

After the layer 316 of silicon nitride is deposited in the foregoing manner (or using other conventional means), the layer 314 of doped polycrystalline silicon is "activated" in a preferred embodiment. This step is undertaken in order to properly place the selected "dopant" atoms (e.g. phosphorous [P] atoms or whatever other dopant is employed) in the proper crystal-lattice positions within the doped polycrystalline silicon layer 314 (to "replace" silicon [Si] atoms at the appropriate locations). In this manner, a resistor 86 having the desired functional capabilities can be fabricated. Activation of the layer 314 is optimally achieved in a representative and non-limiting embodiment by using a conventional furnace apparatus 330 illustrated in FIG. 11 (or other known heating systems/techniques including laser heating, rapid thermal annealing, and the like) to heat the entire structure of FIG. 11 (including the layer 314 of doped polycrystalline silicon) to a preferred temperature of about 900–1000° C. over a time period of about 30–120 minutes. However, these parameters may be varied as needed in accordance with routine preliminary pilot testing taking into account a number of factors including but not limited to the type of construction materials being used and the like. In accordance with this step, the layer 314 of doped polycrystalline silicon material is effectively converted into a resistive compound which will function in a highly efficient manner within the completed printhead 80.

At this point, the size, shape, and overall geometric configuration of the specific resistor 86 under consideration is defined using standard and conventional photoresist imaging processes which are known in the art for this purpose and again discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286 (incorporated herein by reference). To accomplish this step, a selected layer 332 of standard positive photoresist material (FIG. 12) is applied to the upper surface 334 of the layer 316 of silicon nitride. In a representative and preferred (non-limiting) embodiment, the layer 332 of photoresist material will consist of a commercial product sold under the designation "HPR504" produced by the Olin Chemical Corp. of Norwalk, Conn. (USA) which is applied at a preferred and non-limiting uniform thickness "$T_{13}$" of about 1–2 $\mu$m.

Figure 13:
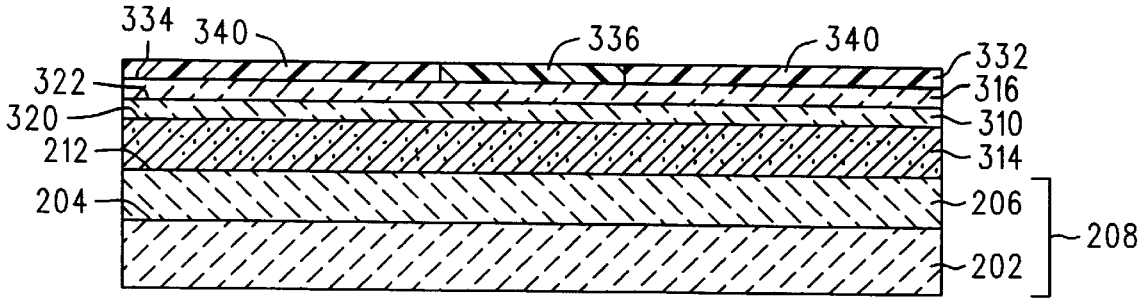

Using standard masking processes which are again well known in the art, the layer 332 of photoresist material is then imaged in a conventional fashion as discussed, for example, in the *Integrated Circuit Fabrication Technology* reference cited above to yield an unexposed region 336 (which is located directly over the portion of the doped polycrystalline silicon layer 314 that will ultimately become the resistor 86) and exposed regions 340 (FIG. 13). Thereafter, with reference to FIG. 14, the exposed regions 340 along with the underlying layers 310, 316 of TEOS and silicon nitride, respectively, are etched away to yield the structure of FIG. 14. While a number of different etching techniques can be employed for this purpose, a preferred procedure for this purpose involves first removing the exposed regions 340 of the photoresist-containing layer 332 by spraying or immersing the structure of FIG. 13 in a conventional resist developer (e.g., a commercial material known as "HPRD429" which is produced by the Olin Chemical Corp. of Norwalk, Conn. (USA)), following by rinsing in deionized water. Thereafter, the layer 316 of silicon nitride is removed by the conventional "dry etching" thereof in a fluorine or chlorine gaseous plasma. Finally, the layer 310 of TEOS may be conventionally removed by chemical etching in a hydrofluoric acid (HF) solution. Again, the foregoing procedure is provided for example purposes only and shall be considered non-limiting.

Figure 14:
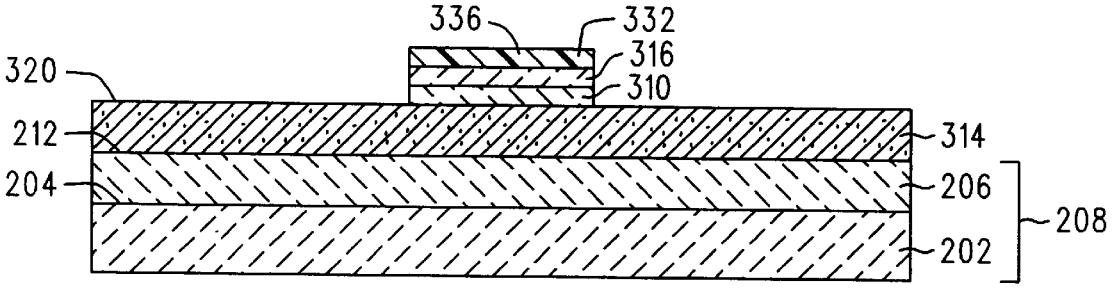

As shown in FIG. 14, the steps described above result in an overall structure wherein the upper surface 320 of the doped polycrystalline silicon layer 314 is "exposed" (revealed) where the regions 340 of the photoresist-containing layer 332 (and layers 316, 310 thereunder) used to be. Likewise, the portion of layer 314 that remains covered by the unexposed region 336 of the photoresist-containing layer 332, layer 316 of silicon nitride, and layer 310 of TEOS will ultimately become the resistor 86 in the completed printhead 80.

At this point, an optional additional step may be undertaken in accordance with an alternative embodiment of the invention if needed and desired based on routine preliminary testing. Specifically, the various "exposed" portions or regions 342 of the polycrystalline silicon-containing layer 314 shown in FIG. 15 can be "augmented" by further doping them with the doping materials that are used to produce the layer 314 in the initial doping stage. In other words, if the layer 314 was initially produced from phosphorous-doped polycrystalline silicon, then the exposed regions 342 will undergo additional phosphorous doping in this embodiment (although other dopants can be used which are different from those employed in the first doping stage of FIG. 9).

As a result of this procedure, the doping level (defined above) of the exposed regions 342 (FIG. 15) will be greater than the corresponding doping level of the portion or section 343 of layer 314 which is located beneath the layers 310, 316, 332 of TEOS, silicon nitride, and photoresist material. These layers 310, 316, 332 serve as "masks" to substantially prevent the further doping of section 343 thereunder. The claimed invention shall not be restricted to any particular differences between the doping level of regions 342 and section 343 as long as some difference exists. Nonetheless, excellent results are achieved if the exposed regions 342 have a doping level (defined above) of about $10^{18}$–$10^{21}$ dopant atoms per $cm^3$ (compared with, for example, the doping range of about $10^{17}$–$10^{20}$ dopant atoms per $cm^3$ listed above in connection with the layer 314 of doped polycrystalline silicon which would likewise correspond to the section 343 in the embodiment of FIG. 15).

To further dope the exposed regions 342 in accordance with the present alternative embodiment, the same process discussed above in connection with the initial doping of the undoped polycrystalline silicon layer 306 is employed, with the foregoing discussion being incorporated in this section by reference. However, to achieve additional doping of the exposed regions 342, substantially the same energy level is employed within the ion implantation apparatus, although the doping "dose" is increased as needed and desired (see, for instance, the representative doping level previously listed in connection with the exposed regions 342). In the example provided above involving phosphorous doping wherein an initial "dose" of about $1.0\times10^{15}$ phosphorous ions per $cm^2$ was employed, the "dose" to be used in connection with the exposed regions 342 would comprise (in a representative and non-limiting embodiment) about $3\times10^{15}$ phosphorous ions per $cm^2$ (or whatever additional levels are desired). The exact parameters and doping levels associated with this alternative embodiment may again be determined in accordance with routine preliminary pilot testing involving the particular construction materials under consideration. Likewise, general information and guidelines involving doping are again described in Elliott, D. J., *Integrated Circuit Fabrication Technology,* McGraw-Hill Book Company, New York (1982)—(ISBN No. 0-07-019238-3), pp. 13–18.

At this stage, the dopants which have been implanted in the exposed regions 342 shown in FIG. 15 will need to be "activated" as previously discussed in connection with the layer 314 of doped polycrystalline silicon in the primary embodiment, with the prior description of activation being incorporated by reference in the present discussion. This step is again undertaken in order to properly place the selected "dopant" atoms (e.g. phosphorous [P] atoms or whatever other dopant is employed) in the proper crystal-lattice positions within the doped polycrystalline silicon-containing exposed regions 342 (to "replace" silicon [Si] atoms at the appropriate locations). However, prior to activation, the remaining unexposed region 336 (FIG. 15) of the photoresist-containing layer 332 is preferably removed using (in a non-limiting embodiment) a two-step process first involving "dry etching" the structure of FIG. 15 in an oxygen plasma and then treating the structure using a "wet cleaning" stage employing, for example, sulfuric peroxide or other comparable materials known in the art for this purpose.

Figure 15:
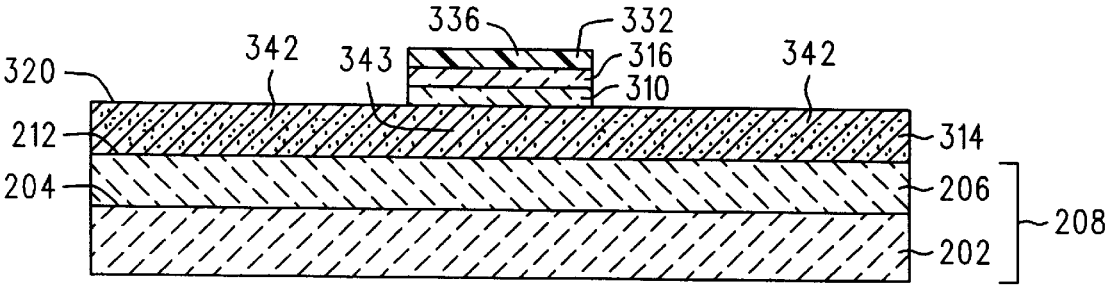
FIG. 15 involves a schematically-illustrated, enlarged cross-sectional view of the various components which are used to fabricate the claimed resistor elements and interconnect structures in an alternative embodiment of the invention.

Activation of the exposed regions 342 is optimally achieved in a representative and non-limiting embodiment by using a standard rapid thermal annealing apparatus (or other known heating systems/techniques including laser heating, or a conventional furnace apparatus of the type shown and discussed above in connection with FIG. 11 at reference number 330) to heat the entire structure of FIG. 15 after removal of the unexposed region 336 of the photoresist-containing layer 332 to a preferred temperature of about 950–1100° C. over a time period of about 15–60 seconds. However, these parameters may be varied as needed in accordance with routine preliminary pilot testing taking into account a number of factors including but not limited to the type of construction materials being used and the like.

A decision to employ the embodiment of FIG. 15 will depend on numerous factors as again determined by routine preliminary testing. For example, the embodiment of FIG. 15 is used to produce reduced-resistance interconnect structures, with the fabrication of such structures being generally outlined below. As a result, the interconnect structures are characterized by a maximum degree of electrical conductivity with minimal levels of "parasitic resistance" (which, if not controlled, can cause increased energy consumption and "hot spots"). The presence of additional dopant materials in the exposed regions 342 facilitates these goals. Accordingly, the system of FIG. 15 will be used on an "as-needed" basis and is prospectively applicable to all of the various embodiments described herein.

Figure 16:
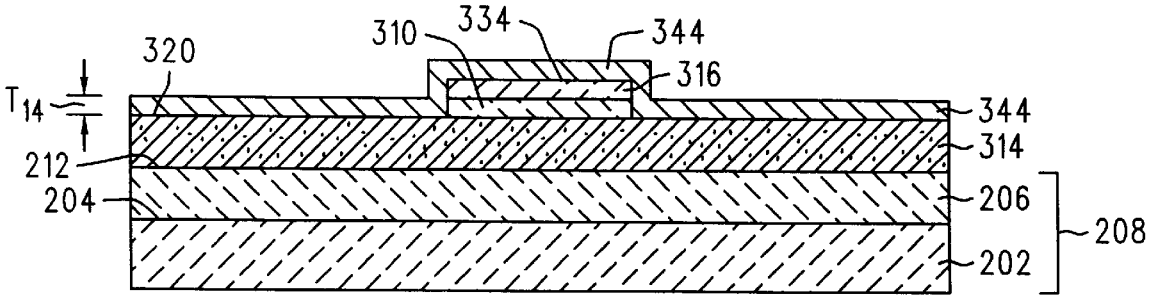

Continuing with the main process discussed above, Thereafter, and with particular reference to FIG. 16, a layer 344 of at least one elemental metal is applied to the entire upper surface of the structure shown in FIG. 14 (or FIG. 15) after the unexposed region 336 of the photoresist-containing layer 332 is removed using the techniques previously discussed in connection with, for example, the embodiment of FIG. 15 which is also applicable to the system of FIG. 14. Specifically, the layer 344 is delivered to (A) the exposed upper surface 320 of the doped polycrystalline silicon-containing layer 314 (which was uncovered using the steps listed above); and (B) the upper surface 334 of the layer 316 of silicon nitride which again remains in position over the structure which will ultimately become the resistor 86. From this point forward, the remaining description will involve treatment of the structure associated with the primary embodiment of FIG. 14 with the understanding that the alternative embodiment of FIG. 15 may likewise be used if needed and desired.

While the claimed invention shall not be restricted to any particular metal compositions (or mixtures thereof) in connection with the layer 344, the following elemental metals are exemplary and preferred: titanium [Ti], cobalt [Co], tungsten [W], platinum [Pt], molybdenum [Mo], tantalum [Ta], palladium [Pd], and mixtures thereof. The selection of any given metal (or combinations of metals) for use in the layer 344 will, in part, involve an assessment of the particular doped polycrystalline silicon material that is selected for use in the layer 314. A number of different metals/doped polycrystalline silicon combinations are possible without limitation. Conventional deposition techniques may be employed for this purpose including but not limited to known sputtering techniques, electron beam evaporation, plasma vapor deposition (PVD), or other comparable methods. As illustrated in FIG. 16, the layer 344 is applied at a preferred and non-limiting uniform thickness "$T_{14}$" about 300–1000 Å.

Figure 17:
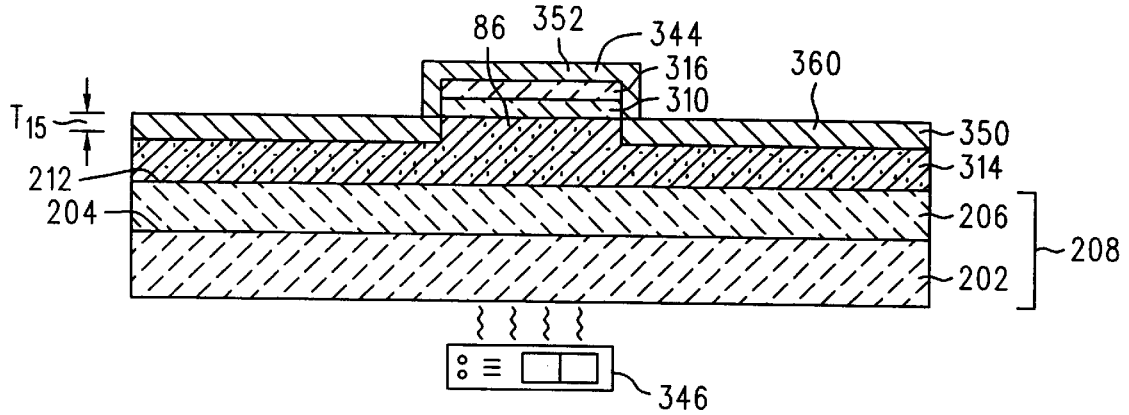

Thereafter, with reference to FIG. 17, the structure shown therein is heated (e.g. annealed) in a conventional manner using a standard rapid thermal annealing apparatus 346 or other comparable device (e.g. a furnace) to a preferred (non-limiting) temperature of about 550–700° C. for about 20–40 seconds. This process initiates a chemical reaction in which the metal employed in the layer 344 reacts with the layer 314 of doped polycrystalline silicon to yield a layer 350 of metal silicide. For example, titanium silicide [$TiSi_2$] will be produced when titanium [Ti] is employed in the layer 344. However, the specific metal silicide to be generated in this step will depend on the particular metal(s) that are used to initially produce the layer 344. The foregoing "silicidation" reaction only occurs where the layer 344 of metal directly contacts the exposed upper surface 320 of the doped polycrystalline silicon-containing layer 314. This reaction does not take place where the layer 344 of metal resides on the layer 316 of silicon nitride as illustrated in FIG. 17.

The procedure described above effectively generates a layer 350 of metal silicide which, as previously stated, may involve many different silicide compounds, depending on the composition(s) selected for use in the metal-containing layer 344. For example, taking into account the particular metals listed above in connection with layer 344, the metal silicide compound in layer 350 could involve the following representative compositions: titanium silicide ($TiSi_2$) when titanium is used in layer 344, cobalt silicide ($CoSi_2$) when cobalt metal is employed in layer 344, tungsten silicide ($WSi_2$) when tungsten metal is present in layer 344, platinum silicide (PtSi) when the layer 344 is made from platinum, molybdenum silicide ($MoSi_2$) when the layer 344 is made from molybdenum, tantalum silicide ($TaSi_2$) when tantalum is employed within the layer 344, palladium silicide ($Pd_2Si$) when the layer 344 is produced from palladium, and mixtures thereof. Thus, the particular metal silicide to be generated in the foregoing process depends on numerous factors including but not limited to the types of materials that are used to produce the metal-containing layer 344 and the layer 314 of doped polycrystalline silicon.

As shown in FIG. 17, the layer 350 of metal silicide is of somewhat greater thickness than the layer 344 of metal in accordance with the reaction discussed above. Specifically, metal atoms in layer 344 diffuse inwardly into the doped polycrystalline silicon layer 314 and chemically react with silicon to generate the metal silicide layer 350. The layer 350 will have a preferred and non-limiting thickness "$T_{15}$" about 400–2000 Å (depending on the relative thickness of the layer 344 and subject to change as needed and desired.)

Figure 18:
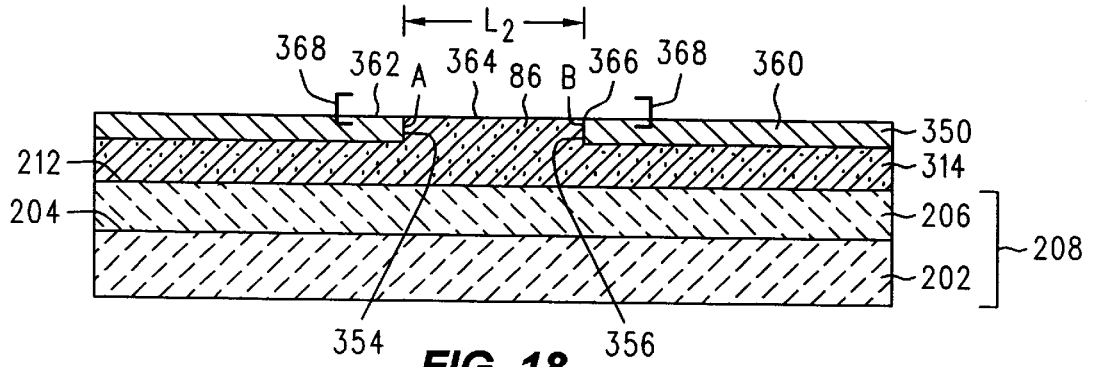

Next, with reference to FIGS. 17 and 18, the remaining portion 352 of the layer 344 of metal (which is present on the upper surface 334 of the silicon nitride-containing layer 316 that is located over the resistor 86) is stripped using, for example, a 5:1:1 stripping solution of dionized water: hydrogen peroxide [$H_2O_2$]: ammonium hydroxide [$NH_4OH$]. It should be noted that the layers 310, 316 of TEOS and silicon nitride thereunder may then be removed if desired using, for example, the procedure outlined above in connection with the process steps shown in FIGS. 13 and 14. In the embodiment of FIG. 18, both of these layers 310, 316 have been removed for the sake of clarity. However, it is actually preferred that the layers 310, 316 remain in place in accordance with their ability to provide additional protection of the underlying resistor 86.

It should likewise be noted that, at this stage, an optional second annealing stage may be undertaken in connection with the structure of FIG. 18 using, for example, the standard annealing/furnace apparatus 346 described above and shown in FIG. 17. This step is implemented in order to stimulate a further phase transformation involving the above-described silicide materials to ensure the lowest possible resistance in the layer 350. In a representative and non-limiting embodiment, the structure of FIG. 18 is heated in the secondary annealing stage (using a conventional rapid thermal annealing apparatus) to a preferred temperature of about 800–900° C. for a time period of about 15–30 seconds. Thereafter, an optional third annealing stage may be implemented if needed and desired based on routine preliminary testing. The third annealing stage (typically called a "forming gas anneal") preferably occurs in a nitrogen [$N_2$]/hydrogen [$H_2$] atmosphere at about 400–500° C. for about 15 minutes–1 hour. The third annealing stage is designed to chemically "tie-up" incompletely bonded silicon atoms at grain boundaries (also known as "dangling bonds").

At this stage, formation of the resistor element 86 is substantially completed, with the outer boundaries of the resistor 86 being shown at reference numbers 354, 356 in FIG. 18. The layer 350 of metal silicide will hereinafter be characterized as the "primary layer 360 of electrically conductive material" which is operatively connected to the resistor 86 as illustrated. In this manner, electrical signals, impulses, and the like from one or more drive transistors and/or external signal sources (not shown) can be delivered to the resistor 86 via the primary layer 360.

In summary, the process outlined above enables individual portions of the doped polycrystalline silicon-containing layer 314 to be "formed" or "converted" into (1) the resistor 86; and (2) the metal silicide-containing primary layer 360 of electrically conductive material in a novel "in situ" process (which constitutes a non-limiting, preferred embodiment of the invention). FIG. 18 shows the primary layer 360 of electrically conductive material on both sides of the resistor 86 (and operatively connected thereto as previously defined). However, it is likewise possible to employ an alternative system in which the primary layer 360 (through selective modification of the foregoing process steps) is only located on one side of the resistor 86 (either to the left or right of the resistor 86) if needed and desired. While the system of FIG. 18 is preferred in most cases, it shall nonetheless be understood that various alternatives are possible.

Further information regarding the primary layer 360 of electrically conductive material and its functional capabilities will now be discussed. Use of the primary layer 360 provides numerous benefits including the avoidance of a direct physical connection between the resistor 86 and conductive circuit elements produced from elemental metals (discussed below) which can create "current crowding" and electromigration problems as previously defined. These problems are effectively controlled/minimized by using the metal silicide-containing primary layer 360 as a "link" or electrically conductive "bridge" to the resistor 86. This unique system likewise avoids "hot spots" and/or undesired concentrations of heat which typically occur in conventional printheads at the junction between the resistor 86 and an elemental metal-containing circuit trace. The specific chemical and physical characteristics of metal silicide compositions allow the connection thereof to the resistor 86 while avoiding the difficulties recited herein.

At this stage, some additional information concerning the geometrical relationship between the resistor 86 and the primary layer 360 of electrically conductive material is in order. As shown in FIG. 18, the primary layer 360 includes a substantially planar (predominantly flat) upper face 362 as illustrated. Likewise, the resistor 86 employs a top surface 364 which is likewise substantially planar (predominantly flat). It is a preferred and novel feature of the claimed invention that the upper face 362 of the primary layer 360 of electrically conductive material and the top surface 364 of the resistor 86 are substantially coplanar with each other (FIG. 18). The term "coplanar" as used herein shall define a relationship between the foregoing components in which the upper face 362 of the primary layer 360 and the top surface 364 of the resistor 86 are both in the same plane and predominantly level with each other to form a smooth and even transition from the upper face 362 to the top surface 364 and vice versa. The word "substantially" as used in connection with the term "coplanar" is employed herein to account for slight allowable deviations from exact coplanarity which are always possible in view of permitted production tolerances, manufacturing limitations, and other factors.

The coplanar relationship described above is employed in a preferred embodiment in order to create a flat, smooth, and substantially planar horizontal surface (discussed further below) at and around the resistor 86. This type of surface is ideally suited to receive additional material layers thereon including various passivation structures as noted above in Section "B". As will become readily apparent from the additional data provided below, the design of the present invention is clearly distinguishable from the conventional system described in Section "B" with particular reference to (1) the inner ends 222 of the conductive layer 214 which each have a sharply angled surface 226 immediately adjacent the resistor 86; and (2) the non-coplanar relationship between the upper surface 232 of the conductive layer 214 and the upper surface 234 of the resistor 86. These features of the conventional system shown in FIG. 4 and outlined in Section "B" create a non-planar region/surface immediately adjacent the resistor 86 (see brackets 228 in FIG. 4) which is difficult to completely and effectively cover with the desired passivation layers. The presence of non-planar geometry within the regions of the printhead 80 immediately adjacent the resistor 86 (e.g. right next to it) typically increases the likelihood of defect formation in the overlying passivation layers including cracks, pinholes, fissures and the like. Such defects can defeat the entire purpose of the passivation layers, thereby leading to undesired ink contact with the resistor 86 and possible corrosion thereof. However, the substantially coplanar relationship between the upper face 362 of the primary layer 360 and the top surface 364 of the resistor 86 avoids these problems by providing a predominantly flat and even surface 366 at the resistor 86 and locations adjacent thereto (e.g. between the brackets 368 in FIG. 18) which is characterized by the absence of sharp angles, slopes, and the like. This flat and even surface 366 is present in the printhead 80 even after the metallic interconnect structures are applied (since they are placed outwardly from the resistor 86 as indicated below). As a result, the overlying passivation or other layers employed in the printhead 80 can be delivered in a manner which creates a high degree of structural integrity and defect-control. Such benefits provide an improved degree of longevity and reliability in the printhead 80. Incidentally, the desired coplanar configuration discussed above is not substantially disrupted or otherwise defeated should the layers 310, 316 of TEOS and silicon nitride be left in position on the resistor 86 in accordance with their small size and thickness characteristics which are of minimal consequence.

All of the steps listed above which are used to manufacture the primary layer 360 of electrically conductive material involve a preferred embodiment for "forming", "creating", and/or "generating" this structure. The foregoing method is preferred since it employs a single layer 314 of doped polycrystalline silicon to construct (1) the resistor 86; and (2) the primary layer 360 of electrically conductive material on an in situ basis. By selectively treating various zones or portions of the doped polycrystalline silicon layer 314 in different ways as outlined herein, both of the foregoing structures can be produced from a common base material (the layer 314) which is economical, efficient, and facilitates formation of the coplanar relationship described above. For example, the embodiment described above involves converting one portion of the layer 314 of polycrystalline silicon into the resistor 86 and also converting at least another portion of the same layer 314 into the primary layer 360. However, the terms "forming", "fabricating", "producing", "attaching", "manufacturing", "creating", "converting" and the like relative to assembly of the claimed components (including the primary layer 360 and/or resistor 86) in all of the embodiments described herein shall be defined to involve: (A) creating the layer or component of interest in situ directly from materials which are already present or otherwise reside in the printhead as discussed above and shown in the accompanying drawing figures; (B) fabricating the layer or component under consideration using one or more conventional material deposition processes (e.g. sputtering, plasma-enhanced chemical vapor deposition [PECVD], and the like); and (C) pre-manufacturing the layer or component in question and thereafter securing it in position within the printhead using chemical or physical attachment means (soldering, adhesive affixation, and the like). All of these techniques can be used to "form" or otherwise "provide" the primary layer 360 of electrically conductive material and the other structures described herein without limitation.

Furthermore, the terms "operatively connected", "operatively connecting", "operatively attached", "operatively attaching", and the like are defined above and generally involve (1) the direct attachment of one component to another component with no intervening materials therebetween; and (2) the attachment of one component to another component with one or more material layers therebetween provided that the one component being "attached" or "connected" to the other component is somehow supported by the other component (notwithstanding the presence of one or more additional material layers therebetween). This aspect of the present invention is of particular importance regarding "operative connection" of the resistor 86 to the primary layer 360 of electrically conductive material. As shown in FIG. 18, operative connection of the resistor 86 and primary layer 360 is accomplished by direct engagement of these components without any intervening materials therebetween at junction points "A" and "B" which are on opposite sides of the resistor 86. The resistor 86 will have a preferred length "$L_2$" of about 5–100 $\mu$m in an exemplary and non-limiting embodiment (with this value also being applicable to the width of the resistor 86). Likewise, the relative thickness of the resistor 86 will be substantially the same as the range recited above in connection with the initial layer 302 of silicon ("$T_{10}$") as shown in FIG. 6. Points "A" and "B" coincide with the outer boundaries of the resistor 86 designated at reference numbers 354, 356. However, it is also contemplated that "operative connection" or "operative attachment" of the resistor 86 to the primary layer 360 could be accomplished through the placement of an intermediate portion 370 of electrically conductive material (FIG. 19) between the primary layer 360 and the resistor 86 on either or both sides of the resistor 86. As a result, the intermediate portion 370 will function as a conductive "bridge" between both components, with the intermediate portion 370 having a representative and non-limiting length "$L_3$" of about 1–10 $\mu$m. Furthermore, in a preferred embodiment, each intermediate portion 370 will have a substantially planar (predominantly flat) upper surface 372 which is substantially coplanar (as defined above) with the upper face 362 of the primary layer 360 and the top surface 364 of the resistor 86 as illustrated.

While the present invention shall not be restricted to any particular materials in connection with the intermediate portion 370 (unless they defeat the purposes of this invention and cause the difficulties listed above in terms of "current crowding" and the like), a preferred embodiment will involve the use of an intermediate portion 370 consisting of the more heavily-doped polycrystalline silicon composition discussed above relative to the embodiment of FIG. 15. The benefits associated with the use of this material to produce the intermediate portion 370 include placement of the primary layer 360 of electrically conductive material in an outwardly-spaced relationship from the resistor 86. This configuration enables the inner ends of the primary layer 360 (discussed further below) to be located at a distance from the resistor 86 which reduces the temperature levels at the inner ends of the primary silicide-containing layer 360. Specifically, when the primary layer 360 is directly connected to the resistor 86 at the metal silicide-polycrystalline silicon junction points "A" and "B" (FIG. 18), these junction points constitute high temperature regions. By using an intermediate portion 370 made of heavily-doped polycrystalline silicon (or other materials) between the resistor 86 and the primary layer 360, the high temperature silicide-silicon junction points discussed above are moved away from the resistor 86, thereby providing reduced silicide temperature levels and the benefits associated therewith (e.g. the avoidance of excess heating and the like).

Figure 19:
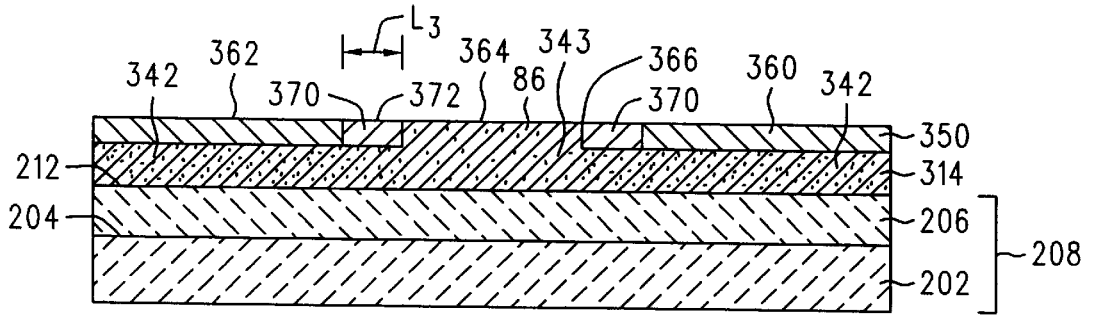
FIG. 19 involves a schematically-illustrated, enlarged cross-sectional view of the various components which are used to fabricate the claimed resistor elements and interconnect structures in a further alternative embodiment of the invention which is related to the embodiment of FIG. 15.

To manufacture the structure shown in FIG. 19 from the system of FIG. 15 using more-heavily doped polycrystalline silicon in the intermediate portion 370, the masking and other procedures listed above which are generally employed to form the metal silicide-containing primary layer 360 are adjusted to move the primary layer 360 outward from the resistor 86. The use of other materials relative to the intermediate portion 370 will employ conventional deposition and masking/photoimaging processes of the type disclosed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. A decision to employ the embodiment of FIG. 19 will depend on numerous factors as again determined by routine preliminary testing. Accordingly, the system of FIG. 19 will be used on an "as-needed" basis and is prospectively applicable to all of the various embodiments described herein.

With reference to FIG. 20, the remaining steps will now be presented which are used to manufacture the completed printhead 80. These steps are applicable to all of the embodiments described herein but will be discussed with primary reference to the main embodiment of FIGS. 5–14 and 16–18. As shown in FIG. 20, positioned on the upper face 362 of the primary layer 360 of electrically conductive material is at least one additional layer 380 of electrically conductive material. While only one additional layer 380 is shown in FIG. 20, it shall be understood that a number of additional electrically conductive layers may be employed on top of each other for this purpose without restriction provided that at least one of them is present on the primary layer 360. The additional layer 380 is placed above the primary layer 360 and is operatively attached thereto, with the term "operatively attached" being defined to encompass direct attachment without any intervening materials therebetween or attachment in a manner where one or more supplemental material layers are located between the additional layer 380 and the primary layer 360.

Many different compositions can be employed in connection with the additional layer 380 of electrically conductive material, with the use of a single elemental metal or multiple elemental metals in combination being preferred. For example, one composition of primary interest which may be used to produce the additional layer 380 involves an alloy of copper [Cu] and aluminum [Al] which will typically (but not exclusively) contain about 0.25–0.75% by weight elemental copper and about 99.25–99.75% elemental aluminum. Other compositions suitable for producing the additional layer 380 include layers of the following metals and metallic compounds: titanium [Ti], gold [Au], copper [Cu], tungsten [W], cobalt [Co], molybdenum [Mo], tantalum [Ta], platinum [Pt], and mixtures thereof. Again, these materials can be employed in various layers, with multiple layers being used if needed and desired in accordance with routine preliminary testing.

Each of foregoing layers will have a preferred and non-limiting uniform individual or group thickness "$T_{16}$" within a range of about 50–10,000 Å which is subject to change as needed and desired. In addition to the embodiment listed above involving a single additional layer 380 made from a copper [Cu]/aluminum [Al] alloy, another representative example would involve the following multiple layers in combination (not shown): (1) a bottom layer made from elemental titanium [Ti] which is applied (e.g. operatively attached/connected) to the upper face 362 of the primary layer 360; (2) a medial layer made from titanium nitride [TiN] positioned on the bottom layer; and (3) a top layer produced from the copper [Cu]/aluminum [Al] alloy discussed above. The titanium nitride layer would be employed in this embodiment to further control junction spiking, electromigration problems and the like.

Regarding deposition methods which may be used to manufacture the additional layer 380 of electrically conductive material, many different metal deposition processes are applicable including those described in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286 with particular reference to conventional sputtering and/or plasma vapor deposition (PVD) techniques.

As illustrated in FIG. 20, the additional layer 380 includes an outer end 384 which is designed for operative connection to one or more drive transistors (e.g. of the "MOSFET" variety) or other control components associated with the printer unit under consideration. However, the additional layer 380 of electrically conductive material terminates within the printhead 80 at an inner end 386 (on one or both sides of the resistor 86 depending on the desired printhead configuration). The inner end 386 is located in a unique position as will now be discussed. Basically, the inner end 386 terminates at a position "C" within the printhead 80 which is spaced outwardly (e.g. laterally) and apart from the resistor 86 in order to form a gap "G" therebetween as shown in FIG. 20. In particular, each inner end 386 of the additional layer 380 stops short of the resistor 86 in order to prevent direct contact therewith. This design is entirely distinguishable from the conventional resistor system illustrated in FIG. 4. With reference to FIG. 4, the conductive layer 214 includes dual portions 220 having inner ends 222 which directly contact the resistor 86 at the terminal edges thereof (which can cause "current crowding", "hot spots", and the like as previously noted). This direct engagement between a layer of material which typically employs one or more elemental metals (namely, the additional layer 380) and the resistor 86 is avoided in the present invention using the arrangement of components discussed above and presented in FIG. 20.

As schematically illustrated in this figure, the gap "G" is effectively "bridged" by the primary layer 360 of electrically conductive material which spans the gap "G" and thereby forms a conductive link therebetween. As a result, electrical communication is established between the additional layer 380 of electrically conductive material and the resistor 86 without placing the resistor 86 in direct physical engagement with materials that can cause the problems listed above. Instead, a conductive bridge is created using the primary layer 360 which is made of a selected metal silicide. The unique chemical and physical properties of this material again avoid the difficulties described herein.

While the present invention shall not be restricted to any particular size parameters in connection with the gap "G", a representative and preferred non-limiting embodiment will involve a gap "G" size (length) of about 5–100 $\mu$m which is subject to change in accordance with routine preliminary testing. It should likewise be noted that the novel design described above (in which each inner end 386 of the additional layer 380 is remotely spaced from the resistor 86) facilitates formation of the predominantly flat and even surface 366 at the resistor 86 and locations adjacent thereto (See FIG. 20) which is characterized by the absence of sharp angles, slopes, and the like. This design controls defect formation in subsequently applied passivation and/or other material layers in the vicinity of the resistor 86. Likewise, the component arrangement of FIG. 20 reduces the need to tightly control the geometrical configuration of each inner end 386 since they will be positioned away from the resistor 86 and therefore of minimal effect. In addition, beneficial thermal effects (including the prevention of excessive heat losses) are achieved in the present invention by avoiding direct contact between the resistor 86 and any elemental metal-containing layers.

As a further point of information, should the embodiment of FIG. 19 be employed which uses one or more intermediate portions 370 of electrically conductive material between the resistor 86 and the primary layer 360, the additional layer 380 described above will not be placed on the intermediate portion(s) 370. Instead, in a preferred embodiment, the inner end 386 of the additional layer 380 will be spaced outwardly from the intermediate portion 370 under consideration and located on the primary layer 360 of electrically conductive material.

At this point, the structure of the present invention is completed and ready for the application of additional layers thereto that are conventionally used in printhead fabrication processes. The claimed invention shall not be limited to the application of any particular layers above the resistor 86, primary layer 360 of electrically conductive material, and additional layer 380 of electrically conductive material with many different variations being possible. These variations include application of the layers discussed above in Section "B" (FIG. 4) which is incorporated in this section (Section "C") by reference. Accordingly, a wide variety of different passivation layers, anti-cavitation layers, barrier layers, and the like may be delivered using the conventional techniques outlined herein without limitation.

As previously stated, the printhead described above represents a considerable departure from prior systems. The resistor system of the present invention offers many advantages ranging from the control/minimization of "current crowding" effects (along with the substantial prevention of electromigration problems) to improved reliability. In the regard, the invention constitutes a significant development in the field of thermal inkjet technology. However, with reference to FIGS. 21–23, an alternative embodiment of the invention is illustrated which employs the novel concepts outlined above but uses a somewhat different approach.

Figure 21:
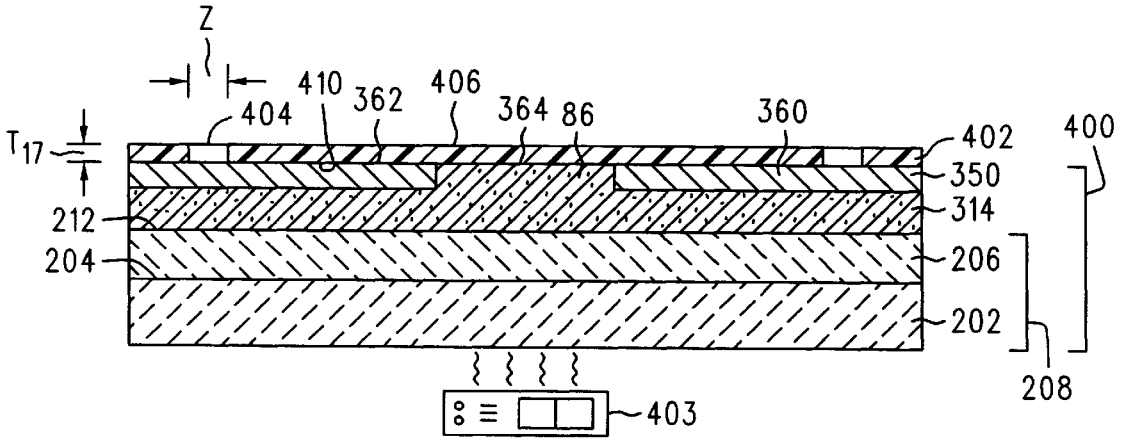
FIGS. 21–23 involve a schematically-illustrated, enlarged cross-sectional view of the various components which are used to fabricate the claimed resistor elements and interconnect structures in a still further alternative embodiment of the invention.

As shown in FIG. 21, the starting structure associated with the current alternative embodiment is the same as that illustrated in FIG. 18 (designated at reference number 400 in FIG. 21). The steps that were used to create the structure of FIG. 18 are discussed above and incorporated by reference in this section of the present description. Likewise, the alternative systems of FIGS. 15 and 19 could also be used in connection with this embodiment. However, for the sake of clarity, the remainder of this discussion will involve the structure of FIG. 18. With continued reference to FIG. 21, at least one protective layer 402 of a dielectric composition is applied to the upper face 362 of the primary layer 360 of electrically conductive material and the top surface 364 of the resistor 86. While the current embodiment shall not be restricted to any particular materials in connection with the protective layer 402 of dielectric material (with the term "dielectric" being defined in a conventional manner above), the following exemplary compositions can be employed for this purpose: silicon carbide [SiC], silicon nitride [$Si_3N_4$ or other stoichiometric variants of this formula], and mixtures thereof. Many different conventional techniques can be used to deliver the protective layer 402 of dielectric material in position depending on the construction materials of interest including but not limited to spin coating processes, chemical vapor deposition (CVD), plasma-enhanced chemical vapor deposition (PECVD), sputtering, and/or low-pressure chemical vapor deposition (LPCVD). Likewise, in order to achieve optimum results, the protective layer 402 will have a preferred and non-limiting uniform thickness "$T_{17}$" of about 1000–4000 Å which is subject to change as needed and desired. The deposited protective layer 402 is then optionally annealed (e.g. strengthened) using a conventional furnace apparatus 403 or similar system at an optimal, non-limiting temperature range of about 400–700° C. over a time period of about 10–30 minutes The layer 402 is designed to function as an electrically insulating protective coating over the components listed above including the resistor 86 and the primary layer 360 of electrically conductive material. At this point, however, an additional feature of the present embodiment will now be discussed. In accordance with FIG. 21, the protective layer 402 is fabricated to include at least one opening 404 therein between the upper surface 406 of the protective layer 402 and the lower surface 410 thereof. The opening 404 may be formed during or after application of the protective layer 402 to the above-described components. This embodiment of the claimed invention shall not be limited to any particular number, orientation, or size parameters in connection with the opening 404 provided that at least one is employed. Any number of openings 404 from 1–10 or more may be used per resistor 86 without limitation. Likewise, the opening 404 may be placed on either or both sides of the resistor 86.

The opening 404 may employ a number of different cross-sectional configurations without limitation. Specifically, the opening 404 may be circular, square, triangular, or any other desired shape in cross-section. In the particular system of FIG. 21, the opening 404 is circular in cross-section with an average, non-limiting diameter "Z" of about 1–5 $\mu$m (with this range likewise being applicable to the length/width values in an opening 404 which employs square, rectangular, or other cross-sectional shapes.)

Many different production methods may be used to fabricate or otherwise form the opening 404 without limitation. For example, each opening 404 may be produced after the protective layer 402 of dielectric material is deposited using a number of standard techniques including conventional dielectric dry etching processes, wet etching methods, ion beam milling, laser ablation, and the like without limitation. Alternatively, the opening 404 may be produced during deposition of the protective layer 402 in accordance with standard and conventional photolithographic patterning/etching processes and other procedures as again outlined in *Integrated Circuit Fabrication Technology,* McGraw-Hill Book Company, New York (1982)—(ISBN No. 0-07-019238-3), pp. 1–40, 43–85, 125–143, 165–229, and 245–286.

Figure 22:
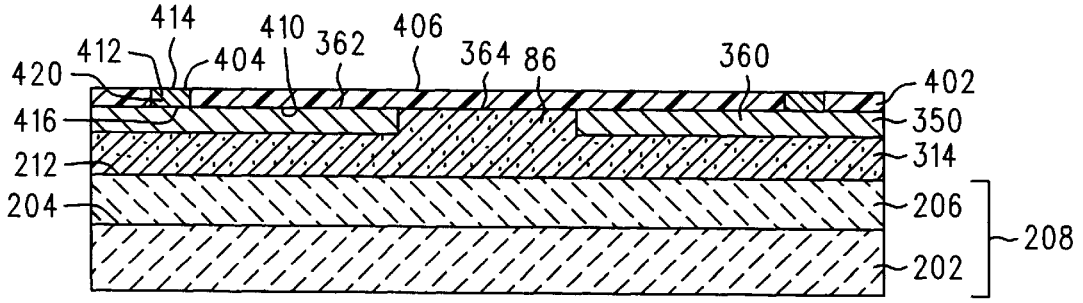

As shown in FIG. 22, each opening 404 is designed to receive at least one electrically conductive contact member 412 therein, with the contact member 412 being directly positioned/embedded within the protective layer 402 as shown. The contact member 412 is designed to establish electrical communication between (1) the additional layer 380 of electrically conductive material to be positioned above the protective layer 402; and (2) the primary layer 360 of electrically conductive material which is located below the protective layer 402. Each contact member 412 includes an upper or first end 414, a lower or second end 416, and a medial section 420.

Many different methods may be employed to produce each contact member 412 within its respective opening 404 without limitation. For example, conventional "plug processing" techniques can be used in which a layer of a selected metal composition (discussed below) is deposited on the entire upper surface 406 of the protective layer 402 and within the opening 404 by sputtering or other standard procedures. Thereafter, the layer is removed from the upper surface 406 by mechanical "polishing" which leaves the opening 404 filled with the metal to form the contact member 412. Alternatively, the contact member 412 may be formed on an in situ basis at the same time that the additional layer 380 of electrically conductive material is applied to the upper surface 406 of the protective layer 402 (discussed below). During this process (using the conventional deposition techniques outlined above), the metallic construction materials associated with the additional layer 380 will "fill in" the opening 404. As a result, the contact member 412 and the additional layer 380 of electrically conductive material will be integrally formed as a single, unitary structure made of the same material.

Figure 23:
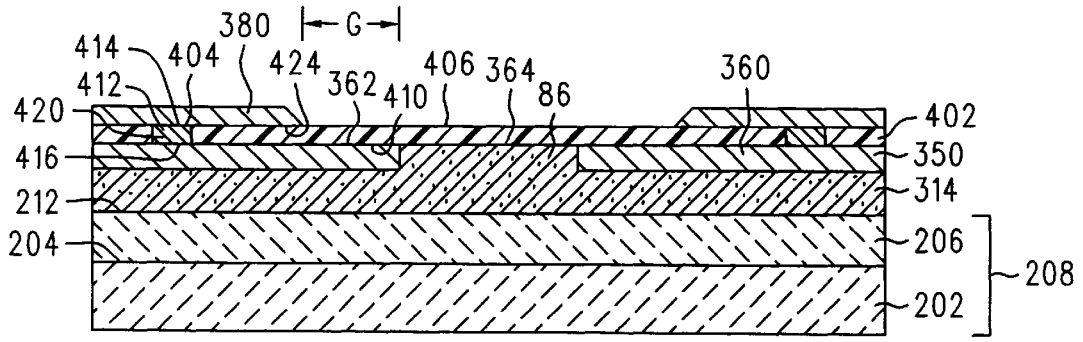

With reference to FIG. 23, formation of the additional layer 380 of electrically conductive material on the upper surface 406 of the protective layer 402 is shown. All of the information, parameters, construction materials, dimensions, and the like concerning the additional layer 380, the gap "G", and other related items are the same as those described above in the main embodiment of FIG. 20. This data in its entirety is therefore incorporated by reference in the present section.

Representative compositions which may be used to produce the contact member 412 include but are not limited to those recited above in connection with the additional layer 380. Some exemplary materials that are suitable for this purpose are as follows: an alloy of copper [Cu] and aluminum [Al] which will typically (but not exclusively) contain about 0.25–0.75% by weight elemental copper and about 99.25–99.75% elemental aluminum, as well as titanium [Ti], gold [Au], copper [Cu], tungsten [W], cobalt [Co], molybdenum [Mo], tantalum [Ta], platinum [Pt], and mixtures thereof.

Regardless of whether the contact member 412 is separately formed prior to application of the additional layer 380 or produced at the same time as the additional layer 380, the contact member 412 forms an electrically conductive link between the overlying additional layer 380 and the underlying primary layer 360. With reference to FIG. 23, the first end 414 of the contact member 412 is in operative connection/attachment with the bottom surface 424 of the additional layer 380. Specifically, the first end 414 of the contact member 412 may be in direct physical engagement with the bottom surface 424 of the additional layer 380 or integrally formed therewith as previously discussed. The second end 416 of the contact member 412 is in operative connection (e.g. direct physical engagement) with the upper face 362 of the primary layer 360. The medial section 420 permits electrical signals/impulses to pass entirely through the contact member 412 from the first end 414 to the second end 416. As a result, the system of FIGS. 21–23 enables the additional layer 380 of electrically conductive material to communicate with the primary layer 360 of electrically conductive material notwithstanding the presence of a protective dielectric layer 402 therebetween. Once the electrical signals/impulses enter the primary layer 360 from the contact member 412, they will thereafter enter resistor 86 in a highly effective manner.

A decision to employ the alternative embodiment listed above will be made on an "as needed" basis in accordance with routine preliminary pilot studies involving the printing systems of interest. In general, the system of FIGS. 21–23 provides many specialized benefits. Specifically, in applying various passivation layers above the resistor 86 as discussed above in Section "B", the temperatures associated therewith must be limited in order to avoid damaging the underlying metal layers. For example, in a conductive trace system involving an alloy of copper [Cu]/aluminum [Al], the temperatures associated with passivation layer formation should not exceed about 400° C. in order to avoid damaging the traces. Higher temperature levels result in a stronger, more durable passivation system having a lower hydrogen content therein, with the relatively low temperature value listed above defeating this goal. However, if the protective layer 402 shown in FIG. 23 is employed as a passivation layer for protecting the resistor 86, it is formed before the temperature-sensitive additional layer 380 is applied. This process allows high passivation layer deposition temperatures (e.g. within the range recited above of about 500–700° C.) to be used in connection with the protective layer 402. In this manner, a very strong passivation system is created within the printhead 80 while avoiding damage to the temperature-sensitive layers therein.

D. Ink Delivery Systems using the Novel Printhead and Resistor System

In accordance with the information presented above, a unique printhead 80 having a high degree of thermal stability, reliability, structural integrity, and efficiency is disclosed. The benefits associated with this structure (which are provided by the specialized resistor system and arrangement of interconnect components discussed above) are summarized in the previous sections. In addition to the printheads described herein, this invention shall also encompass an "ink delivery system" which is constructed using the claimed printhead designs that employ the specialized materials and structures listed in Sections "A"–"C" above. Accordingly, all of the data in Sections "A"–"C" shall be incorporated by reference in the present section (Section "D").

In order to produce the ink delivery system of the present invention, an ink containment vessel is provided which is operatively connected to and in fluid communication with the claimed printhead system. The term "ink containment vessel" is defined above and can involve any type of housing, tank, or other structure designed to hold a supply of ink therein (including the ink composition 32). The terms "ink containment vessel", "ink storage vessel", "housing", "chamber", and "tank" shall all be considered equivalent from a functional and structural standpoint. The ink containment vessel can involve, for example, the housing 12 employed in the self-contained cartridge 10 of FIG. 1 or the housing 172 associated with the "off-axis" system of FIGS. 2–3. Likewise, the phrase "operatively connected" shall encompass a situation in which the printhead is directly attached to an ink containment vessel as shown in FIG. 1 or remotely connected to an ink containment vessel in an "off-axis" manner as illustrated in FIG. 3. Again, an example of an "on-board" system of the type presented in FIG. 1 is provided in U.S. Pat. No. 4,771,295 to Baker et al., with "off-axis" ink delivery units being described in co-owned U.S. patent application Ser. No. 08/869,446 (filed on Jun. 5, 1997 and now U.S. Pat. No. 6,158,853). entitled "AN INK CONTAINMENT SYSTEM INCLUDING A PLURAL-WALLED BAG FORMED OF INNER AND OUTER FILM LAYERS" (Olsen et al.) and co-owned U.S. patent application Ser. No. 08/873,612 (filed Jun. 11, 1997) and now U.S.

Pat. No. 5,975,686 entitled "REGULATOR FOR A FREE-INK INKJET PEN" (Hauck et al.), with all of these applications and patents being incorporated herein by reference. Such references describe and support "operative connection" of the claimed printhead (e.g. printhead 80 or 196) to a suitable ink containment vessel, with the data and benefits recited in Sections "A"–"C" again being incorporated by reference in the current section (Section "D"). This data includes the materials, components, numerical parameters, and other factors associated with the claimed resistor system which employs (1) a resistor 86; (2) a primary layer 360 of electrically conductive material that is operatively connected to the resistor 86 as previously defined; and (3) and at least one additional layer 380 of electrically conductive material which is operatively attached to and above the primary layer 360. As previously noted, the additional layer 380 terminates at a position within the printhead 80 which is remotely spaced from the resistor 86 to form a gap therebetween.

In addition, the ink delivery system further includes at least one layer of material having at least one opening (e.g. orifice) therethrough which is secured in position above the foregoing components so that the opening is in partial or (preferably) complete axial alignment (e.g. "registry") with the resistor 86 and vice versa. Again, the opening is designed to allow ink materials to pass therethrough and out of the printhead 80. Further information regarding the types of structures which can be employed in connection with the orifice-containing layer of material (namely, the orifice plate 104 having the orifice 108 therein or other equivalent structures) is recited in Section "B".

In conclusion, the present invention involves a novel printhead system which is characterized by many benefits. These benefits are discussed in detail above and constitute a substantial advance in thermal inkjet technology. Such benefits again include, without limitation: (1) the effective control/minimization of "current crowding" problems as defined above, with this benefit leading to improved electrical efficiency; (2) reductions in printhead operating temperatures; (3) the general promotion of more favorable temperature conditions within the printhead (which result from reduced current requirements that correspondingly decrease current-based parasitic heat losses from the interconnect structures attached to the resistors); (4) the ability to employ a simplified, substantially planar internal printhead design (with particular reference to the resistor element[s] and associated interconnection hardware) which allows more effective coverage of these components by one or more protective layers; (5) improved overall reliability, stability, and longevity levels in connection with the printhead and resistor elements based on the improvements recited above; (6) the avoidance of heating efficiency problems which can lead to resistor "hot spots", absolute limits on resistance, and the like; (7) the ability to place more resistors within a given printhead in view of the reduced operating temperatures and other factors listed herein which facilitates the reduced-cost production of large-area printheads; and (8) generally superior long-term operating performance.

Having herein set forth preferred embodiments of the invention, it is anticipated that various modifications may be made thereto by individuals skilled in the relevant art which nonetheless remain within the scope of the invention. For example, the invention shall not be limited to any particular ink delivery systems, operational parameters, numerical values, dimensions, ink compositions, and component orientations within the general guidelines set forth above unless otherwise stated herein. The present invention shall therefore only be construed in accordance with the following claims.

The invention that is claimed is:

1. A high efficiency ink delivery printhead comprising:

at least one resistor element positioned within said printhead for expelling ink on-demand therefrom, said resistor element being comprised of a doped polycrystalline silicon composition;

at least one primary layer of electrically conductive material which is operatively connected to said resistor element, said primary layer being comprised of a metal silicide compound; and at least one additional layer of electrically conductive material positioned above said primary layer of electrically conductive material and being operatively attached thereto, said additional layer terminating at a position within said printhead which is spaced outwardly and apart from said resistor element in order to form a gap therebetween, said primary layer forming a conductive bridge within said gap between said additional layer and said resistor element.

2. The printhead of claim 1 wherein said doped polycrystalline silicon composition is selected from the group consisting of phosphorous-doped polycrystalline silicon, boron-doped polycrystalline silicon, arsenic-doped polycrystalline silicon, antimony-doped polycrystalline silicon, and mixtures thereof.

3. The printhead of claim 1 wherein said metal silicide compound is selected from the group consisting of titanium silicide, cobalt silicide, tungsten silicide, platinum silicide, molybdenum silicide, tantalum silicide, palladium silicide, and mixtures thereof.

4. The printhead of claim 1 wherein said gap between said additional layer and said resistor element is about 5–100 $\mu$m in length.

5. The printhead of claim 1 wherein said primary layer of electrically conductive material comprises a substantially planar upper face and said resistor element comprises a substantially planar top surface, said upper face of said primary layer and said top surface of said resistor element being substantially coplanar relative to each other.

6. A high efficiency ink delivery printhead comprising:

at least one resistor element positioned within said printhead for expelling ink on-demand therefrom, said resistor element being comprised of a phosphorous-doped polycrystalline silicon composition, said resistor element further comprising a substantially planar top surface;

at least one primary layer of electrically conductive material which is operatively connected to said resistor element, said primary layer being comprised of titanium silicide and further comprising a substantially planar upper face, said upper face of said primary layer and said top surface of said resistor element being substantially coplanar relative to each other; and at least one additional layer of electrically conductive material positioned above said primary layer of electrically conductive material and being operatively attached thereto, said additional layer of electrically conductive material being comprised of an alloy comprising copper and aluminum therein, said additional layer terminating at a position within said printhead which is spaced outwardly and apart from said resistor element in order to form a gap therebetween, said primary layer forming a conductive bridge within said gap between said additional layer and said resistor element.

7. An ink delivery system for use in generating printed images comprising:

a printhead comprising:

at least one resistor element positioned within said printhead for expelling ink on-demand therefrom, said resistor element being comprised of a doped polycrystalline silicon composition;

at least one primary layer of electrically conductive material which is operatively connected to said resistor element, said primary layer being comprised of a metal silicide compound; and at least one additional layer of electrically conductive material positioned above said primary layer of electrically conductive material and being operatively attached thereto, said additional layer terminating at a position within said printhead which is spaced outwardly and apart from said resistor element in order to form a gap therebetween, said primary layer forming a conductive bridge within said gap between said additional layer and said resistor element; and an ink containment vessel operatively connected to and in fluid communication with said printhead.

8. A method for producing a high efficiency ink delivery printhead comprising:

providing at least one resistor element for expelling ink on-demand from said printhead, said resistor element being comprised of a doped polycrystalline silicon composition;

forming at least one primary layer of electrically conductive material which is in operative connection with said resistor element, said primary layer being comprised of a metal silicide compound; and operatively attaching at least one additional layer of electrically conductive material in position within said printhead above said primary layer of electrically conductive material, said additional layer terminating at a position within said printhead which is spaced outwardly and apart from said resistor element in order to form a gap therebetween, said primary layer forming a conductive bridge within said gap between said additional layer and said resistor element.

9. A method for producing a high efficiency ink delivery printhead comprising:

providing a layer comprised of doped polycrystalline silicon;

forming at least one resistor element from at least one portion of said layer of doped polycrystalline silicon, said resistor element expelling ink on-demand from said printhead;

converting at least one additional portion of said layer of doped polycrystalline silicon into a metal silicide compound in order to produce at least one primary layer of electrically conductive material comprised of said metal silicide compound; and operatively attaching at least one additional layer of electrically conductive material in position within said printhead above said primary layer of electrically conductive material, said additional layer terminating at a position within said printhead which is spaced outwardly and apart from said resistor element in order to form a gap therebetween, said primary layer forming a conductive bridge within said gap between said additional layer and said resistor element.

10. A high efficiency ink delivery printhead comprising:

at least one resistor element positioned within said printhead for expelling ink on-demand therefrom, said resistor element being comprised of a doped polycrystalline silicon composition;

at least one primary layer of electrically conductive material which is operatively connected to said resistor element, said primary layer being comprised of a metal silicide compound;

a protective layer of dielectric material positioned above and operatively attached to said primary layer of electrically conductive material and said resistor element;

at least one additional layer of electrically conductive material positioned above and operatively attached to said protective layer of dielectric material, said additional layer terminating at a position within said printhead which is spaced outwardly and apart from said resistor element in order to form a gap therebetween; and at least one electrically conductive contact member positioned within said protective layer of dielectric material, said contact member being operatively connected to said additional layer of electrically conductive material which is located above said protective layer, with said contact member also being operatively connected to said primary layer of electrically conductive material which is located below said protective layer, said contact member forming an electrically conductive link between said additional layer and said primary layer.

11. The printhead of claim 10 wherein said metal silicide compound is selected from the group consisting of titanium silicide, cobalt silicide, tungsten silicide, platinum silicide, molybdenum silicide, tantalum silicide, palladium silicide, and mixtures thereof.

12. The printhead of claim 10 wherein said gap between said additional layer and said resistor element is about 5–100 $\mu$m in length.

13. The printhead of claim 10 wherein said primary layer of electrically conductive material comprises a substantially planar upper face and said resistor element comprises a substantially planar top surface, said upper face of said primary layer and said top surface of said resistor element being substantially coplanar relative to each other.

14. The printhead of claim 10 wherein said dielectric material used in said protective layer is selected from the group consisting of silicon carbide, silicon nitride, and mixtures thereof.

15. An ink delivery system for use in generating printed images comprising:

a printhead comprising:

at least one resistor element positioned within said printhead for expelling ink on-demand therefrom, said resistor element being comprised of a doped polycrystalline silicon composition;

at least one primary layer of electrically conductive material which is operatively connected to said resistor element, said primary layer being comprised of a metal silicide compound;

at least one protective layer of dielectric material positioned above and operatively attached to said primary layer of electrically conductive material and said resistor element;

at least one additional layer of electrically conductive material positioned above and operatively attached to said protective layer of dielectric material, said additional layer terminating at a position within said printhead which is spaced outwardly and apart from said resistor element in order to form a gap therebetween; and at least one electrically conductive contact member positioned within said protective layer of dielectric material, said contact member being operatively connected to said additional layer of electrically conductive material which is located above said protective layer, with said contact member also being operatively connected to said primary layer of electrically conductive material which is located below said protective layer, said contact member forming an electrically conductive link between said additional layer and said primary layer; and an ink containment vessel operatively connected to and in fluid communication with said printhead.

16. A method for producing a high efficiency ink delivery printhead comprising:

providing at least one resistor element for expelling ink on-demand from said printhead, said resistor element being comprised of a doped polycrystalline silicon composition;

forming at least one primary layer of electrically conductive material in operative connection with said resistor element, said primary layer being comprised of a metal silicide compound;

operatively attaching at least one protective layer of dielectric material in position within said printhead above said primary layer of electrically conductive material and said resistor element;

forming at least one electrically conductive contact member within said protective layer of dielectric material; and operatively attaching at least one additional layer of electrically conductive material in position within said printhead above said protective layer of dielectric material, said additional layer terminating at a position within said printhead which is spaced outwardly and apart from said resistor element in order to form a gap therebetween, said contact member being operatively connected to said additional layer of electrically conductive material which is located above said protective layer, with said contact member also being operatively connected to said primary layer of electrically conductive material which is located below said protective layer, said contact member forming an electrically conductive link between said additional layer and said primary layer.

17. A high efficiency ink delivery printhead comprising:

at least one resistor element positioned within said printhead for expelling ink on-demand therefrom, said resistor element being comprised of a doped polycrystalline silicon composition;

at least one primary layer of electrically conductive material which is operatively connected to said resistor element, said primary layer being comprised of a metal silicide compound;

an intermediate portion of electrically conductive material positioned between said primary layer of electrically conductive material and said resistor element in order to form an electrically conductive pathway therebetween; and at least one additional layer of electrically conductive material positioned above said primary layer of electrically conductive material and being operatively attached thereto, said additional layer terminating at a position within said printhead which is spaced outwardly and apart from said resistor element in order to form a gap therebetween, said primary layer forming a conductive bridge within said gap between said additional layer and said resistor element.

18. A high efficiency ink delivery printhead comprising:

at least one resistor element positioned within said printhead for expelling ink on-demand therefrom, said resistor element being comprised of a doped polycrystalline silicon composition;

at least one primary layer of electrically conductive material which is operatively connected to said resistor element, said primary layer being comprised of a metal silicide compound;

an intermediate portion of electrically conductive material positioned between said primary layer of electrically conductive material and said resistor element in order to form an electrically conductive pathway therebetween, said intermediate portion of electrically conductive material being comprised of a doped polycrystalline silicon composition having a doping level which is greater than that of said resistor element, said resistor element likewise being comprised of a doped polycrystalline silicon composition; and at least one additional layer of electrically conductive material positioned above said primary layer of electrically conductive material and being operatively attached thereto, said additional layer terminating at a position within said printhead which is spaced outwardly and apart from said resistor element in order to form a gap therebetween, said primary layer forming a conductive bridge within said gap between said additional layer and said resistor element.

19. A method for producing a high efficiency ink delivery printhead comprising:

providing a layer comprised of doped polycrystalline silicon;

forming at least one resistor element from at least one portion of said layer of doped polycrystalline silicon, said resistor element expelling ink on-demand from said printhead;

further doping at least one additional portion of said layer of doped polycrystalline silicon so that said additional portion has a doping level which is greater than that of said portion of said layer of doped polycrystalline silicon which was used to produce said resistor element;

converting said additional portion of said layer of doped polycrystalline silicon into a metal silicide compound in order to produce at least one primary layer of electrically conductive material comprised of said metal silicide compound; and operatively attaching at least one additional layer of electrically conductive material in position within said printhead above said primary layer of electrically conductive material, said additional layer terminating at a position within said printhead which is spaced outwardly and apart from said resistor element in order to form a gap therebetween, said primary layer forming a conductive bridge within said gap between said additional layer and said resistor element.

* * * * *